US011519089B1

(12) United States Patent
Faure et al.

(10) Patent No.: US 11,519,089 B1
(45) Date of Patent: Dec. 6, 2022

(54) METHODS AND SYSTEMS FOR AUTOMATED OPTIMIZATION OF $CO_x$ ELECTROLYSIS REACTOR

(71) Applicant: Dioxycle, Bordeaux (FR)

(72) Inventors: Bastien Faure, Bordeaux (FR); Sarah Lamaison, Bordeaux (FR); David Wakerley, Bordeaux (FR)

(73) Assignee: Dioxycle, Bordeaux (FR)

( * ) Notice: Subject to any disclaimer, the term of this patent is extended or adjusted under 35 U.S.C. 154(b) by 0 days.

(21) Appl. No.: 17/403,453

(22) Filed: Aug. 16, 2021

(51) Int. Cl.
*C25B 15/023* (2021.01)
*C25B 3/26* (2021.01)

(52) U.S. Cl.
CPC ..... *C25B 15/023* (2021.01); *C25B 3/26* (2021.01)

(58) Field of Classification Search
CPC ..... C25B 3/26; C25B 15/023; C25B 15/00; C25B 1/04; C25B 15/02; C25B 15/06; C25B 1/23; C25B 9/70; C25B 9/65; C25B 9/17; C25B 9/19; C25B 3/25; C25B 13/08; C25B 1/00; C25B 9/73; C25B 9/23; C25B 15/08; C25B 11/061; C25B 11/052; C25B 9/15; C25B 3/07; C25B 3/03; C25B 11/057; C25B 11/077; H02S 10/10; H02J 3/381; H02J 2300/30; H02J 2300/28; H02J 2300/26; Y02E 10/56; Y02E 60/36; Y02E 60/50; Y02P 70/50; Y02P 20/133; C25D 11/34; C25D 3/38; C25D 5/50;

(Continued)

(56) References Cited

U.S. PATENT DOCUMENTS 6,591,199 B2 * 7/2003 Tremblay ..... G05B 23/024 702/35
9,255,335 B2 2/2016 Kanan et al.
(Continued)

FOREIGN PATENT DOCUMENTS

EP 3670701 A1 6/2020
EP 3795720 A1 3/2021
(Continued)

OTHER PUBLICATIONS

De Luna et al., "What Would It Take for Renewably Powered Electrosynthesis to Displace Petrochemical Processes?", Science 364, eaav3506, Apr. 26, 2019, retrieved from http://science.sciencemag.org/ on Jul. 26, 2021, 11 pages.
(Continued)

*Primary Examiner* — Xiuyu Tai
(74) *Attorney, Agent, or Firm* — Daylight Law, P.C.

(57) ABSTRACT

Methods and systems related to the field of carbon capture and utilization are disclosed. A disclosed method for controlling an electrolysis system with a plurality of electrolysis cells includes several steps. The electrolysis system converts a fluidic flow containing $CO_x$ into at least one chemical. The method includes monitoring, using at least one sensor, a plurality of electrolysis cells. The method also includes identifying, via the monitoring, a degrading cell in the plurality of electrolysis cells. The method also includes modifying, upon the identifying of the degrading cell and while continuing to operate at least one other cell in the plurality of electrolysis cells, an operational state of the plurality of electrolysis cells.

22 Claims, 10 Drawing Sheets

(58) Field of Classification Search
CPC ..... H01M 8/04955; H01M 8/04559; H01M 8/04552; H01M 8/04589; H01M 8/04477; H01M 8/0444; H01M 8/04365; G05B 23/0221; G05B 23/024
See application file for complete search history.

(56) References Cited

U.S. PATENT DOCUMENTS

| | | | | |
|---|---|---|---|---|
| 9,370,773 | B2 | 6/2016 | Masel et al. | |
| 2011/0240483 | A1* | 10/2011 | Tremblay | C25B 15/02 204/229.8 |
| 2020/0208278 | A1 | 7/2020 | Li et al. | |

FOREIGN PATENT DOCUMENTS

| | | | |
|---|---|---|---|
| WO | 2020240218 | A1 | 12/2020 |
| WO | 2021108446 | A1 | 6/2021 |

OTHER PUBLICATIONS

Jouny et al., "A General Techno-Economic Analysis of CO2 Electrolysis Systems", Ind. Eng. Chem. Res. 2018, 57, 6, 23 pages.
Li et al., Electrolytic Conversion of Bicarbonate into CO in a Flow Cell:, Joule 3, Jun. 19, 2019, pp. 1487-1497.
Matthew Jouny et al., "Formation of Carbon-Nitrogen Bonds in Carbon Monoxide Electrolysis", Nat. Chern. 2019, 11, 38 pages.

* cited by examiner

METHODS AND SYSTEMS FOR AUTOMATED OPTIMIZATION OF $CO_x$ ELECTROLYSIS REACTOR

BACKGROUND

Carbon dioxide ($CO_2$) accumulation in the atmosphere is a major culprit in global warming. Capturing it at emitting point sources or directly from the air (through direct air capture) and converting it into valuable chemicals and fuels using a decarbonized source of electricity is a promising way to both reduce its atmospheric concentration and offer sustainable alternatives to current fossil-fuel-derived feedstocks. Among the envisioned conversion technologies, polymer-electrolyte-membrane-based electroreduction technology stands out by its versatility (possible use at a wide range of temperatures and pressures, possible intermittent use) and amenability to generate a wide range of products.

Electroreduction of $CO_2$ has been reported to produce carbon monoxide (CO), formic acid, ethylene, ethanol, ethane, propanol, propylene, acetaldehyde among other products. Potential of this technology has been covered by several reviews. Electroreduction of bicarbonate and carbonate ions ($HCO_3^-$ and $CO_3^{2-}$), in which $CO_2$ favorably evolves in a low (respectively high) alkalinity aqueous solution, are also being explored. This is of particular interest as major $CO_2$ capture technologies involve contacting $CO_2$ with alkaline aqueous solutions to form such bicarbonate and carbonate-containing compounds, that have limited added value as such. Finally, an increasing attention is drawn to CO electroreduction. Coupled with a first step ensuring the conversion of $CO_2$ into CO (by any means such as but not limited to electroreduction, hydrogenation of $CO_2$ or gasification of carbon-containing feedstocks such as but not limited to waste, biomass), CO electroreduction has been reported as a potential economically viable means to produce certain commodities such as ethylene. Electroreduction of CO and N-containing reactants such as but not limited to $NH_3$, $NO_2$ and $NO_3^-$ is also of major interest to reinvent industrial chemical processes involving the creation of C—N bonds.

In the following disclosure, $CO_2$, CO and other members of the oxocarbon family will be jointly referred to as $CO_x$. A $CO_x$ electrolysis reactor typically consists of one or multiple stacks, each comprising at least one or multiple cells that are stacked onto one another. In a stack, each individual cell comprises two half cells interfaced by an ion-conducting media such as but not limited to a polymer-electrolyte membrane: an anodic compartment where oxidation of water or an alternative reactant takes place and a cathodic compartment where the reduction of at least $CO_x$ into a targeted product takes place. Each half cell consists of a flow field that ensures both electrical contact and the provision of reactants to a porous and conductive support (such as a gas diffusion layer (GDL) or a porous metal support), the latter being in direct contact with a catalyst at the surface of which reactions take place. The assembly formed by the two porous supports and respective catalysts together with the central one or more membranes is referred to as a membrane-electrode assembly (MEA). In a stack, individual cells are physically supported on each side by conductive polar plates (either bipolar or monopolar). A bipolar plate supports the flow field of one and the next cell on each of its sides and ensures the series connection between two adjacent cells. At each end of the stack, the terminal polar plate is referred to as monopolar since it only supports a flow field and adjacent cell on one of its sides. For conciseness in the following, a cell will jointly refer to a central catalytic assembly (such as but not limited to an MEA in the case where the ion-conducting media is membrane-based) including the two flow fields and supporting polar plates.

Multiple other electrolysis reactor configurations are possible. Some prior art studies report a circular modular electrolyzer and process to convert carbon dioxide to gaseous products at elevated pressure and with high conversion rate or provide example of a rectangular electrolyzer for gaseous carbon dioxide conversion. In all cases, focus centers around the architecture of the cells.

A wide variety of membrane electrodes assemblies are also possible. Tremendous efforts have been dedicated to exploring catalysts candidates varying both their chemical nature (e.g., metal alloys, single-metal-site catalysts, molecular species, use of additives) and structure (e.g., nanoparticles, dendrites, films). In all cases, efforts have centered around chemically modifying the electrocatalytic systems to increase their performance and stability.

$CO_x$ electrolysis reactors are complex and therefore subject to frequent failures and performance degradations. They can be hard to maintain: the access is difficult for human operators in charge of their maintenance. For these reasons above, the operating costs can be high. In the path towards industrialization, there is now a need to maximize reactor performance metrics as well as the capacity factor (i.e. the ratio between the actual rate at which the plant production is operated vs. the maximum production rate). It is also desirable to limit the maintenance costs and reduce the maintenance time of an electrolysis reactor comprising multiple electrolysis cells. A solution can be to find ways to maintain the performance of the stack for as long as possible before stopping the system for maintenance operation and minimize the duration of such maintenance operations.

SUMMARY

Methods and systems related to the field of carbon capture and utilization are disclosed. The methods and systems described in this disclosure can be environmentally beneficial for the conversion of $CO_x$ accumulated in the atmosphere by electrochemical reduction into other chemicals, such as valuable and sustainable chemicals and/or fuels, and for the automatic control and optimization of the efficiency of an electrolysis system or electrolyzer including electrolysis stacks.

Specific embodiments of the invention refer to methods and systems to increase the time of utilization of an electrolysis system at a given performance level. The performance level of an electrolysis system can decrease due to the effect of degrading cells and/or degrading stacks. As used herein, the term "degrading cells" include cells whose performance is predicted to decline due to the detected operating state of the cell, cells whose performance has measurably declined, and failed cells whose performance has declined so much that it is effectively no longer functional. Similarly, the term "degrading stack" include stacks whose performance is predicted to decline due to the detected operating state of the stack, stacks whose performance has measurably declined, and failed stacks whose performance has declined so much that it is effectively no longer functional. A degrading/failed stack can include a stack comprising more than an acceptable number of degrading/failed cells. Some of the methods described herein are directed to the monitoring of the performance of an electrolysis system, the identification of a degrading and/or failed state, and the triggering of an action to minimize degradation, avoid failure and/or solve the failure. In this regard, methods are disclosed that include the identification of a degrading and/or failed cell and/or stack, and the modification of an operational state of such cell and/or stack to delay further degradation and eventual failure. Such methods include, for example, changing an operational parameter in the system to prolong the cell and/or stack operations. The methods further include the identification of failed cells among the degrading cells (for example cells for which degradation has passed a certain limit or cells that are not working at all). In these cases, the modification of the operational state can include the actual disabling of the cell and/or stack in the system. Once the number of failed cells has exceeded an acceptable value so that the overall quantity of $CO_x$ converted is too low (for example because too many cells are disabled), then a replacement step can be performed, via a mechanical helper such as but not limited to those exemplified in this disclosure, to change the failed cells as fast and as efficiently as possible.

In this disclosure, the term degrading cell includes a cell for which an operational characteristic, such as electrical resistance, differs from a reference value. The example of electrical resistance will be generally used in this disclosure, but those skilled in the pertinent art will recognize that other operational characteristics could be used to identify a degrading or failed cell, such as those that depend directly or indirectly from the electrical resistance (e.g., voltage and current). The electrical resistance of a cell is defined as the ratio between the cell voltage (difference in electrical potential between the two electrodes of the cell) and the electrical current flowing across the cell. The electrical resistance of a cell can be obtained by different means, such as but not limited to using impedance spectroscopy techniques or can be inferred from measurements of the current and cell voltage. Alternatively, the electrical resistance of a cell can be directly inferred from the cell voltage measurement and from the current of one or more cells connected in series with the first cell.

The reference value can depend on multiple factors such as but not limited to the geometry of the system, the nature of the reaction, the type of product targeted and the operating conditions. The reference value of the electrical resistance of a cell can be established based on knowledge of the expected behavior of the system or system components. It can also be defined with respect to the electrical resistance of the other cells, for example by comparing the electrical resistance of the cell to the averaged electrical resistance of a group of cells within the plurality of cells. The reference value can be a fixed value or can also integrate correction factors to account for the operating conditions of the system, such as differences in temperature between the cells. In that case, a different reference value may be used for different cells in different operating conditions. Based on the above definitions, a degrading cell can be defined by an electrical resistance differing from its reference value in relative terms. In specific embodiments of the invention, the electrical resistance differs from its reference value by at least 0.1%. In specific embodiments of the invention, the electrical resistance differs from its reference value by at least 0.5%. In specific embodiments of the invention, the electrical resistance differs from its reference value by at least 1%. In specific embodiments of the invention, the electrical resistance differs from its reference value by at least 1.5%. In specific embodiments of the invention, the electrical resistance differs from its reference value by at least 3%. In specific embodiments of the invention, the electrical resistance differs from its reference value by at least 5%. In specific embodiments of the invention, the electrical resistance differs from its reference value by at least 10%. These differences can be either positive or negative. In specific embodiments of the invention, the threshold used to define a degrading cell could be adjusted by a system operator according to a desired performance level.

In specific embodiments of the invention, a degrading cell is a failed cell, which is a cell for which the difference in a specific operational characteristic (e.g., electrical resistance) with respect to a reference value exceeds a particular threshold. Hence, a failed cell can be defined by an electrical resistance differing from its reference value in relative terms. In specific embodiments of the invention, the electrical resistance differs from its reference value by at least 3%. In specific embodiments of the invention, the electrical resistance differs from its reference value by at least 5%. In specific embodiments of the invention, the electrical resistance differs from its reference value by at least 10%. In specific embodiments of the invention, the electrical resistance differs from its reference value by at least 20%. In specific embodiments of the invention, the electrical resistance differs from its reference value by at least 30%. In specific embodiments of the invention, the electrical resistance differs from its reference value by at least 50%. These differences can be either positive or negative. In specific embodiments of the invention, the threshold used to define a cell failure could be adjusted by a system operator according to the desired performance level.

By identifying a degrading cell/stack and then modifying an operational state of the system accordingly (for example by changing an operational parameter to avoid further degradation), it can be possible to extend the lifetime of the system. By identifying a failed cell/stack and then modifying an operational state of the system accordingly (for example by disabling such cell/stack), it can also be possible to extend the life of the system even after failure. Furthermore, when too many cells/stacks are disabled, the present invention further proposes systems and mechanisms that allow for the quick replacement of cells without major impact in the overall performance of the system.

Specific embodiments of the present invention therefore offer means for extending the life of an electrolysis system and quick ways to deal with degradation, failure and replacement of cells and stacks. This can produce significant benefits in the field of the invention because electrodes in electrolysis systems for the specific applications disclosed herein need to be replaced more often as opposed to other applications where electrodes are more stable. Similarly, bypassing or disabling may not be as important in other systems as there may be less harm, for example to a power generation system, if one cell is not generating as much power as it could.

In specific embodiments of the invention, a method for controlling an electrolysis system with a plurality of electrolysis cells, wherein the electrolysis system converts a fluidic flow containing $CO_x$ into at least one chemical, is provided. The method comprises monitoring, using at least one sensor, the plurality of electrolysis cells. The method also comprises identifying, via the monitoring, a degrading cell in the plurality of electrolysis cells. The method also comprises modifying, upon the identifying of the degrading cell and while continuing to operate at least one other cell in the plurality of electrolysis cells, an operational state of the plurality of electrolysis cells.

In specific embodiments of the invention, an electrolysis system is provided. The system comprises a plurality of electrolysis cells configured to receive a fluidic flow containing $CO_x$ and convert the $CO_x$ into at least one chemical. The system also comprises at least one sensor configured to monitor the plurality of electrolysis cells. The system also comprises at least one processor and a non-transitory computer-readable media accessible to the at least one processor and storing instructions which, when executed by the at least one processor, cause the system to: monitor, using the at least one sensor, the plurality of electrolysis cells; identify, via the monitoring, a degrading cell in the plurality of electrolysis cells; and modify, upon the identifying of the degrading cell and while continuing to operate at least one other cell in the plurality of electrolysis cells, an operational state of the plurality of electrolysis cells.

In specific embodiments of the invention, an electrolysis system is provided. The system comprises a stack of electrolysis cells. A cell of the stack of electrolysis cells includes a plate, such as but not limited to a polar plate. The system also comprises a first stack casing located on a first end of the stack of electrolysis cells. The system also comprises at least one locking mechanism for the plate and the first stack casing to move away, under a degree of compression, from a second end of the stack. Part of the stack, for example a group of cells, are further individually referred to as "sub-stack".

DETAILED DESCRIPTION

Figure 1:
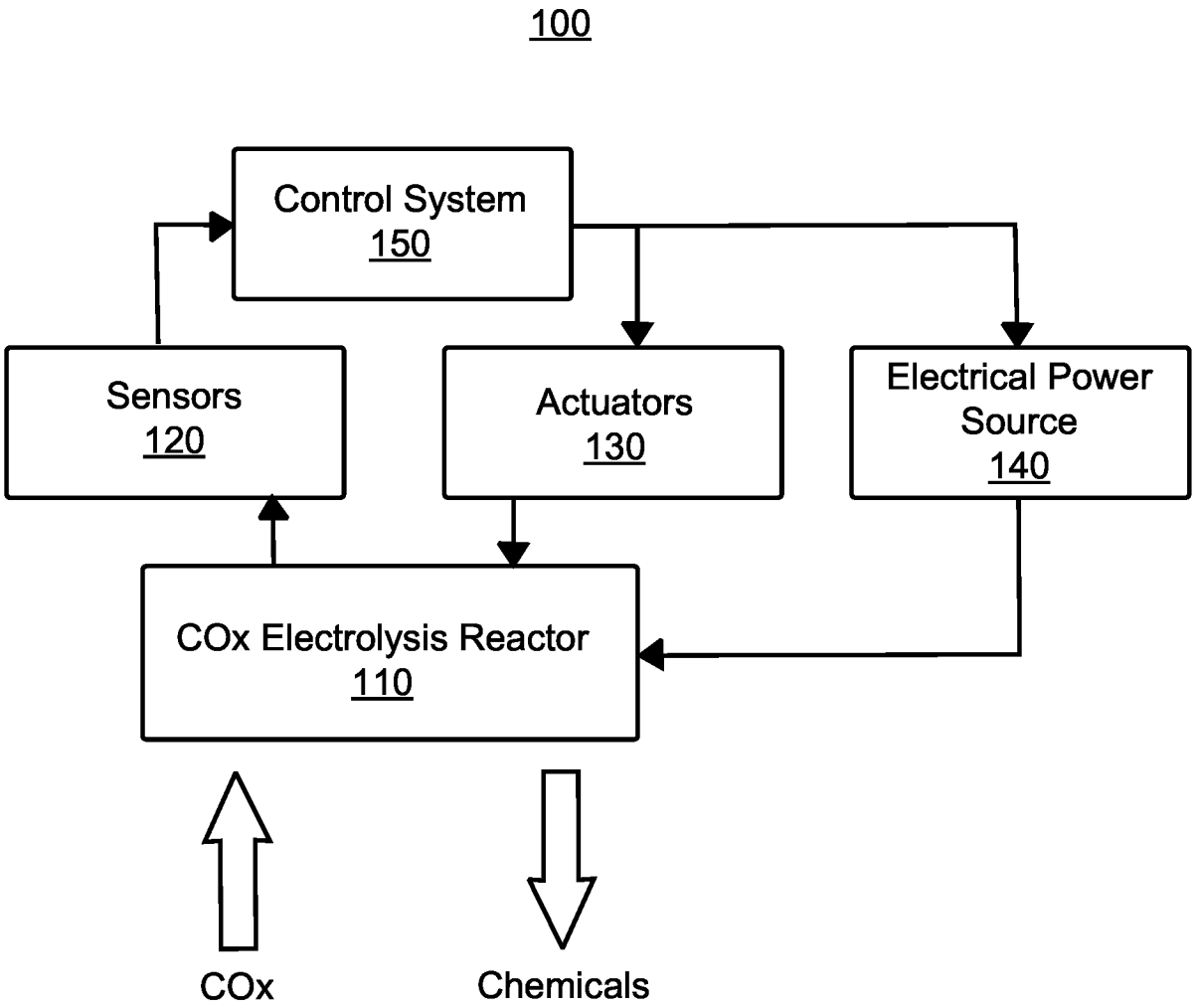
FIG. 1 includes a block diagram of an electrolysis system, in accordance with specific embodiments of the invention disclosed herein.

Specific embodiments of the invention refer to an electrolysis system. The electrolysis system can be for converting $CO_x$, or a fluidic flow containing $CO_x$, into at least one chemical, for example converting carbon dioxide ($CO_2$) or carbon monoxide (CO) into a desired product such as a carbon-based commodity. FIG. 1 includes a block diagram of an electrolysis system 100 in accordance with specific embodiments of the invention. The electrolysis system 100 comprises a $CO_x$ electrolysis reactor 110, such as a $CO_2$ or CO electrolysis reactor, one or more sensors 120, one or more actuators 130, an electrical power source 140 and a control system 150.

In specific embodiments of the invention, the $CO_x$ electrolysis reactor of the electrolysis system, such as $CO_x$ electrolysis reactor 110 of electrolysis system 100 of FIG. 1, can be composed of a plurality of electrolysis cells configured to receive a fluidic flow (e.g., liquid or/and gaseous) and convert, when power is applied, $CO_x$ (such as $CO_2$ or CO) from the fluidic flow into at least one chemical, such as an alternative product that can be a desired and/or beneficial product (such as but not limited to CO, alkanes, alcohols, carboxylic acids).

Figure 2:
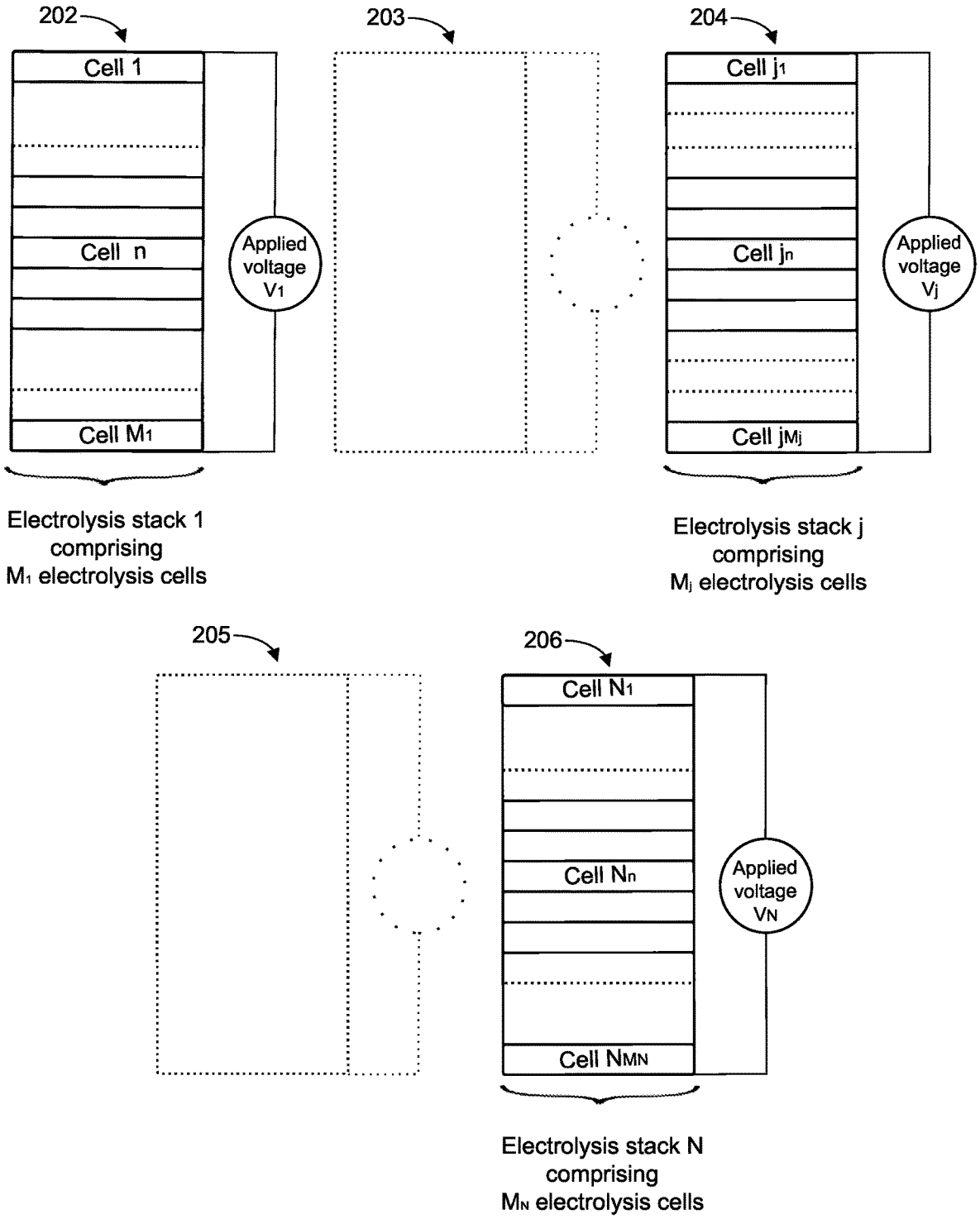
FIG. 2 includes an example of an electrolysis reactor comprising a plurality of cells arranged in a plurality of stacks, in accordance with specific embodiments of the invention disclosed herein.

FIG. 2 includes an example of an electrolysis reactor comprising a plurality of cells arranged in a plurality of stacks. In this example, the electrolysis reactor includes a first electrolysis stack 202 which comprises $M_1$ electrolysis cells, including Cell 1, Cell n, and cell $M_1$ as illustrated. The electrolysis reactor includes additional electrolysis stacks, such as electrolysis stack 204 and 206, representing electrolysis stacks j and N in the reactor, and comprising $M_j$ and $M_N$ electrolysis cells, respectively. The reactor can include any number of stacks and/or cells, as represented by the placeholders 203 and 205 which represent the fact that any other number of stacks could be provided in the reactor.

The plurality of electrolysis cells in the electrolysis reactor can be arranged in different configurations as depicted in FIG. 2. For example, one or several electrolysis cells can be arranged in series. In that case, the anode of a cell can be electrically connected to the cathode of the subsequent cell and so on. Such an arrangement is called an electrolysis stack. One or several stacks can then be arranged in parallel. In that case, a voltage difference can be applied on the terminal electrodes of each electrolysis stack.

The cells may have various shapes including but not limited to circular, or polygonal such as but not limited to rectangular, square, pentagonal, hexagonal, octagonal, etc. In the case where the cells are arranged in an electrolysis stack, similar or different shapes may be adopted for the other elements of the stack.

Figure 3:
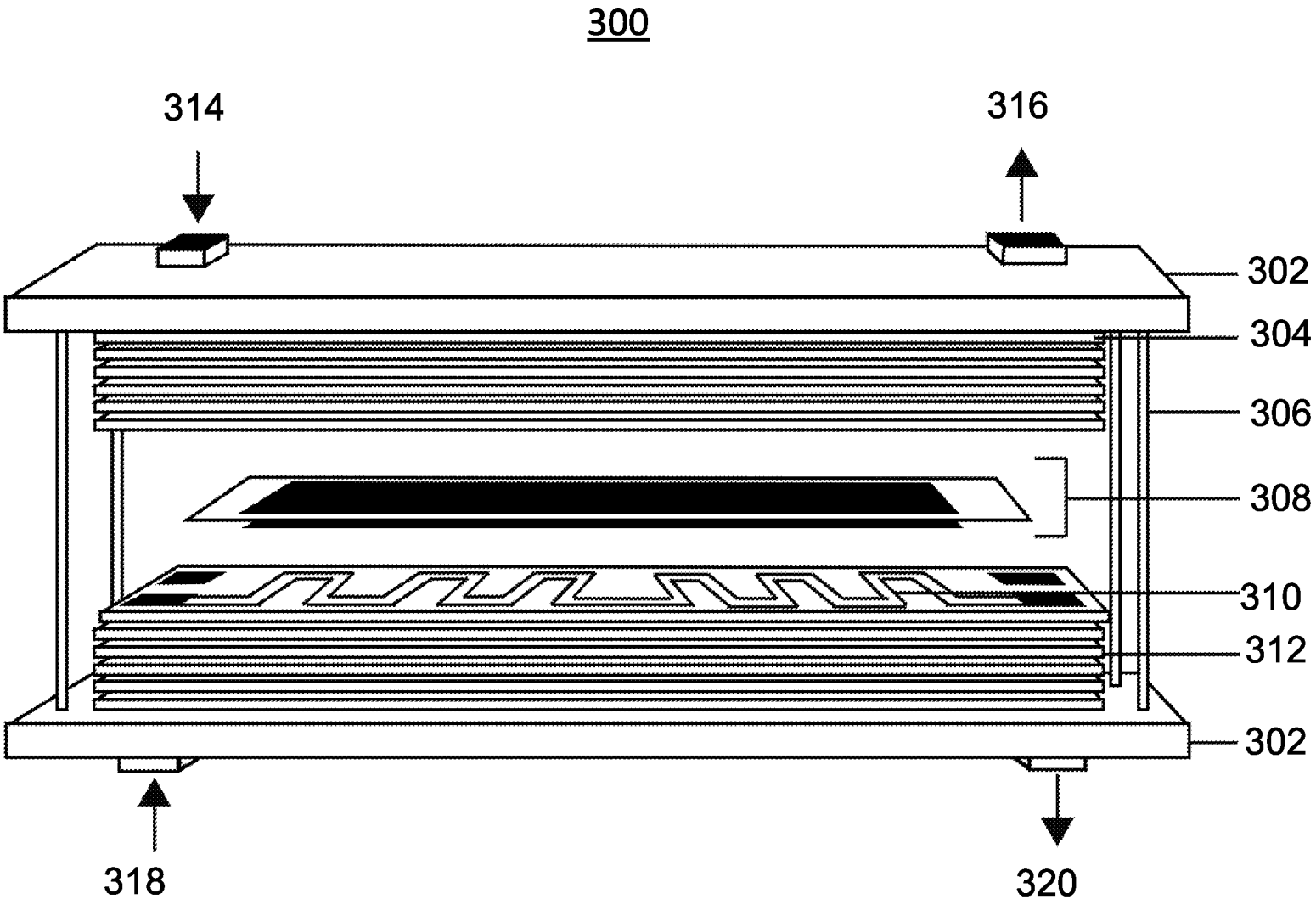
FIG. 3 includes an illustration of an electrolysis stack and open view of one cell, in accordance with specific embodiments of the invention disclosed herein.

FIG. 3 includes an illustration of an electrolysis stack 300 in accordance with specific embodiments of the invention disclosed herein. The stack 300 includes end plates such as 302, monopolar plates such as 304, rigid bars such as 306, a membrane electrode assembly (MEA) such as 308, a flow field such as 310, and bipolar plates such as 312. Additionally, the stack 300 includes an inlet 314 and an outlet 316 for an anodic stream, as well as an inlet 318 for $CO_x$ containing cathodic stream and an outlet 320 for the cathodic stream. The polar plates, such as monopolar plate 304 and bipolar plate 312 can be part of the cells in the stack.

In an electrolysis stack, subsequent cells can be physically separated by bipolar plates (BPPs), such as bipolar plate 312 in FIG. 3, that can ensure mechanical support for each of the electrolysis cells on each side of the BPP. BPP can also ensure electrical series connection between subsequent electrolysis cells and introduce/remove the reactants/products respectively. At the end of the stack, only one side of the plate can be in contact with the terminal cell; it is then called a monopolar plate, such as monopolar plate 304 in FIG. 3.

At the extremities of the stack, current collectors can allow connection to an external power supply, which can also be used, among other elements, for electrical monitoring of the stack. The stack can be assembled within a stack casing allowing its mechanical support and compression, as well as provisioning and transporting the reactant and product streams to and from the stack. The stack casing can comprise end plates that ensure electrical isolation of the stack and provide the inlet and outlets for the reactant and product streams.

In specific embodiments of the invention, the plate (bipolar or monopolar) can comprise various materials and/or surface coatings. For example, the plate can comprise stainless steel (for example but not limited to 316L), titanium, graphite or a mixture thereof. The plate may comprise one or more surface coatings (e.g., comprising Ti, Cr, Nb, Ni, Fe) on one or more faces of the polar plates in contact with one or more electrochemical cells to minimize contact resistance and improve chemical resistance (notably to corrosion).

In specific embodiments of the invention, the input fluid flow can comprise of $CO_2$, CO, $HCO_3^-$, $CO_3^{2-}$, $H_2O$, $N_2$, Ar, and/or an ion-containing aqueous solution, such as an electrolyte water in the presence of dissolved salts, (or a mixture thereof). The input fluid flow can also comprise contaminants such as $SO_x$ or $NO_x$. In specific embodiments of the invention, the anode flow, also referred to as anolyte, can comprise water in liquid form, in the presence of dissolved salts (e.g., CsOH, KOH, $CsHCO_3$, $Cs_2CO_3$, $KHCO_3$, $K_2CO_3$, $NaHCO_3$, $Na_2CO_3$). In specific embodiments of the invention, the cathode flow may in particular comprise humidified $CO_2$ and/or CO. For example, humidified $CO_2$ or humidified CO can be used at the cathode and ion-containing aqueous solution can be used at the anode. As another example, the cathodic flow can be diluted with inert gases such as $N_2$ and Ar. It can also be possible to use $HCO_3^-$ or $CO_3^{2-}$ (instead of $CO_2$) as $HCO_3^-$ and $CO_3^{2-}$ are solubilized forms of $CO_2$ in alkaline media. In specific embodiments of the invention, the cathodic flow could include: $CO_2$, CO, $HCO_3^-$, $CO_3^{2-}$, $H_2O$, $N_2$, Ar; and the anodic flow could include: water, $H_2$, ion-containing aqueous solution. In specific embodiments of the invention, the input cathodic fluid flow may also be comprised of flue gas, for example to valorize industrial $CO_2$ (from industrial flue gases). In this case, the cathodic fluid may comprise additionally to $CO_2$ and/or CO, contaminants such as $SO_x$ and $NO_x$. In specific embodiments of the invention, the input anodic fluid flow may comprise wastewater.

An electrolysis cell is an electrochemical cell that allows non-spontaneous reactions by the use of an electrical power source. Electrolysis cells can comprise at least one: flow-field (for example for ensuring electrical contact and transport of reactant and/or product), porous electrode support, electrode (such as cathode, anode), catalyst (for example integrated and/or in contact with the electrode), ion-conducting media (such as, but not limited to, one or more membranes, ion-conducting electrolyte, diaphragm or oxide-conducting materials such as ceramics). In specific embodiments of the invention, the flow field can comprise a ladder, single or multiple serpentines, interdigitated patterns, pillars, bio-inspired leaf-like shapes or a mixture thereof. An electrolysis cell can also include polar plates as further discussed in this disclosure.

In specific embodiments of the invention, the porous electrode can be selected from carbon-based porous supports or metal-based porous material. The carbon-based porous support can be based on carbon fibers, carbon cloth, carbon felt, and the like or a mixture thereof. The carbon-based porous support can be a gas diffusion layer with or without microporous layer (such as, but not limited to, Sigracet 39BC, Sigracet 35BC, Sigracet 28BB, Sigracet 28BC, Toray paper, Freudenberg H23C6) with or without microporous layer. The metal-based porous support can be selected from Titanium, stainless steel, Ni and can be under the form of mesh, frit, foam or plate.

In specific embodiments of the invention, the ion-conducting media between adjacent cathode and anode that ensures ion conduction between the two can be made of one or multiple polymer electrolyte membranes pressed between the anode and cathode, forming a Membrane Electrode Assembly (MEA).

In specific embodiments of the invention, the polymer electrolyte membranes can include, without limitation, an anion-exchange membrane, a cation-exchange membrane, and/or a bipolar membrane. The anion-exchange membrane can contain an organic N-containing species that is positively charged, such as pyridinium, imidazolium, piperidinium, as well as additional functionality to improve mechanical/electronic stability, such as styrene or other aromatic or cross-linked polymers. This can include structures that may be in commercially available Sustainion, Piperion, Fumasep or similar structures. The cation-exchange membrane can contain anion functionality, such as in sulfonate, phosphonate or carboxylate groups. This can be supported on a polymer-containing aromatic, aliphatic or fluorinated carbon chains. This can include structures that may be present in commercially available Aquivion, Nafion, or similar structures. The bipolar exchange membrane can comprise a cation-exchange membrane in addition with an anion-exchange membrane and can be selected from Fumasep FBM, Xion or comprise a combination of the structures described in cation and anion exchange membranes mentioned above. These membranes can also include a central water dissociation layer with metal oxide particles, such as $TiO_2$, $IrO_x$ or $NiO_x$.

In specific embodiments of the invention, the catalyst can comprise one or more: molecular species, single-metal-site heterogeneous compounds, metal compounds, carbon-based compounds, polymer electrolytes (also referred to as ionomers), metal-organic frameworks, or any other additives. The molecular species can be selected from metal porphyrins, metal phthalocyanines or metal bipyridine complexes. The metal compound can be under the form of metal nanoparticles, nanowires, nano powder, nanoarrays, nanoflakes, nanocubes, dendrites, films, layers or mesoporous structures. The single-metal-site compounds can comprise a metal-doped carbon-based material or a metal-N—C-based compound. The metal compound can comprise Ag, Au, Zn, Cu, Ir, Pt, Fe, Ni, Co, Mn, Sn, Bi, Pd, Pb, Cd, Ru, Re, Rh, an alloy of such metals or a mixture thereof. The polymer electrolyte can be selected out of the same materials as the one used for the described membranes. The carbon-based compounds can comprise carbon nanofibers, carbon nanotubes, carbon black, graphite, boron-doped diamond powder, diamond nanopowder, boron nitride or a combination thereof. The additives can be halide-based compounds including F, Br, I, Cl. The additives can be specifically dedicated to modify hydrophobicity such as treatment with polytetrafluoroethylene (PTFE), or carbon black.

In specific embodiments of the invention, the application of a difference in electrical potential to the electrodes can generate an electrical current from the anode to the cathode powering the reduction of $CO_x$ (such as $CO_2$ or CO) into chemicals at the cathode and the oxidation of a reactant at the anode (such as but not limited to the oxidation of water into oxygen or the partial oxidation of hydrocarbons or alcohols, the oxidation of organic waste, the oxidation of hydrogen, etc.). An anode reaction can include one or multiple of the following reactions that can be undertaken in acidic/neutral environment (left column) or neutral/alkaline environment (right column).

| Reaction in acidic/neutral environment | Reaction in neutral/alkaline environment |
|---|---|
| $2\ H_2O \rightarrow O_2 + 4\ H^+ + 4\ e^-$ | $4OH^- \rightarrow O_2 + 2H_2O + 4e^-$ |
| $2CO_3^{2-} \rightarrow O_2 + 2CO_2 + 4e^-$ | $2CO_3^{2-} \rightarrow O_2 + 2CO_2 + 4e^-$ |
| $HCO_3^- \rightarrow ½\ O_2 + CO_2 + H^+ + 2e^-$ | $HCO_3^- + OH^- \rightarrow ½\ O_2 + CO_2 + H_2O + 2e^-$ |
| $H_2 \rightarrow 2H^+ + 2e^-$ | $H_2 + 2OH^- \rightarrow 2H_2O + 2e^-$ |

A cathode reaction can include one or multiple of the following reactions that can be undertaken in acidic/neutral environment (left column) or neutral/alkaline environment (right column).

| Reaction in acidic/neutral environment | Reaction in neutral/alkaline environment |
|---|---|
| $CO_2 + 2H^+ + 2e^- \rightarrow CO + H_2O$ | $CO_2 + H_2O + 2e^- \rightarrow CO + 2OH^-$ |
| $CO_2 + 2H^+ + 2e^- \rightarrow HCOOH$ | $CO_2 + H_2O + 2e^- \rightarrow HCOO^- + OH^-$ |
| $2CO_2 + 12H^+ + 12e^- \rightarrow C_2H_4 + 4H_2O$ | $2CO_2 + 8H_2O + 12e^- \rightarrow C_2H_4 + 12OH^-$ |
| $CO_2 + 8H^+ + 8e^- \rightarrow CH_4 + 2H_2O$ | $CO_2 + 6H_2O + 8e^- \rightarrow CH_4 + 8\ OH^-$ |
| $2CO_2 + 12\ H^+ + 12e^- \rightarrow CH_3CH_2OH + 3H_2O$ | $2CO_2 + 9H_2O + 12e^- \rightarrow CH_3CH_2OH + 12OH^-$ |
| $2CO_2 + 2e^- + 2H^+ \rightarrow$ COOH—COOH | $2CO_2 + 2e_- + 2H_2O \rightarrow$ COOH—COOH $+ 2OH_-$ |
| $2CO_2 + 4e^- + 4H^+ \rightarrow$ HCO—COOH $+ H_2O$ | $2CO_2 + 4e^- + 3H_2O \rightarrow$ HCO—COOH $+ 3OH^-$ |
| $2H^+ + 2e^- \rightarrow H_2$ | $2H_2O + 2e^- \rightarrow H_2 + 2OH^-$ |

As a result, the anode stream can comprise $O_2$ and/or $CO_2$ and/or $H_2O$ (or a mixture thereof); the cathode stream can comprise CO and/or $CO_2$ and/or hydrogen ($H_2$) and/or water ($H_2O$) and/or formic acid (HCOOH) and/or ethylene ($C_2H_4$) and/or ethane ($C_2H_6$) and/or ethanol ($CH_3CH_2OH$) and/or methane ($CH_4$) and/or oxalic acid (COOH—COOH) and/or glyoxylic acid (COH—COOH) and/or propane ($C_3H_8$) and/or propene ($C_3H_6$) and/or propanol ($C_3H_7OH$).

With reference back to FIG. 1, the electrolysis system 100 also includes an electrical power source 140 that can be responsible for applying a voltage on the terminal electrodes (monopolar plates) of each electrolysis stack. The voltage applied to the different stacks may differ depending on the number of electrolysis cells in the stack and the operating conditions.

The electrolysis system of FIG. 1 also includes sensors 120 that can be arranged to ensure monitoring of certain operational parameters of the electrolysis system. An operational parameter can be defined as a physical parameter of the electrolysis system that can be measured by the means of a sensor, and can include, but is not limited to: at least one difference in electrical potential for at least one electrolysis cell composing the electrolysis reactor; at least one electrical current flowing through at least one cell or stack composing the electrolysis reactor; the molecular composition of the output stream of chemicals, including but not limited to concentration or proportion of CO, $CO_2$, $H_2$, $C_2H_4$, $CH_3CH_2OH$, and other products (for example, the molecular composition of the cathodic output stream of chemicals, including but not limited to concentration or proportion of CO and/or $CO_2$ and/or hydrogen ($H_2$) and/or water ($H_2O$) and/or formic acid (HCOOH) and/or ethylene ($C_2H_4$) and/or ethane ($C_2H_6$) and/or ethanol ($CH_3CH_2OH$) and/or methane ($CH_4$) and/or oxalic acid (COOH—COOH) and/or glyoxylic acid (COH—COOH) and/or propane ($C_3H_8$) and/or propene ($C_3H_6$) and/or propanol ($C_3H_7OH$), and/or the molecular composition of the anodic output stream of the chemicals, including but not limited to concentration or proportion of $O_2$ and/or $CO_2$ and/or $H_2O$ and/or $H_2$). Other operational parameters can also be considered such as, but not limited to, temperature, humidity, pressure and flow rate of the $CO_x$-containing flow stream at the cathode, or temperature, humidity, pressure and flow rate of the fluid, such as water, fed at the anode, pH of the anolyte, etc.

The electrolysis system of FIG. 1 also includes actuators 130 that can be arranged to modify either the operation parameters of the electrolysis system (including but not limited to temperature/pressure/humidity of the input flow stream at the cathode and/or anode, flow rates at the cathode and/or anode) or the electrolysis system configuration itself. These can be achieved, for example, according to instructions provided by the control system described hereunder. In this way, an operation state of the electrolysis system can be modified. Non-limiting examples of actuators are: pumps, flow regulators, valves such as two-way valves, three-way valves, gas or liquid heating systems, heat exchangers, electrical contactors etc.

The electrolysis system of FIG. 1 also includes a control system 150 which can comprise at least one memory and one processor, or more memories, processors and microcontrollers. The memories and processors can be distributed locally or hosted remotely such as on the cloud or external servers, such a distribution being determined for an optimal regulation of the electrolysis system or according to the requirements/constraints of the specific system. The control system can be configured to execute one or more programs, for example by executing instructions stored in memory, that when executed, can cause the system to perform certain actions. For example, the system can receive data sent by operational parameter sensors such as sensors 120. The data can include performance metrics such as cell resistance. The data can be further used by the system for subsequent actions, for example the data can be displayed for live monitoring of the electrolysis system configuration, and/or stored (e.g., in the form of time-series) for further analysis. As another example, the system can control actuators, such as actuators 130, to implement regulations of the operational parameters (temperature, flow rates, pressure, etc.). As another example, the system can analyze the data sent by the operational parameter sensors. The data can be analyzed for various purposes such as to provide live estimates of one or several performance metrics of the electrolysis system. Time series or other data stored in the control system memory can also be analyzed, either locally or in the cloud or on external servers, for example to provide forecasting capabilities of one or several operation parameters and/or performance metrics. As another example, the system can trigger actions such as, but not limited to, raising alerts to inform an operator of the state of the electrolysis system or to plan a maintenance, adapting the operation parameters set points according to the operator instructions or to the results of the aforementioned data analysis, modifying the electrolysis system configuration, for example by disabling one or several electrolysis cells and/or stacks, etc.

In this way and as will be described in the examples below in more detail, a system such as system 100 of FIG. 1 can be configured to monitor, for example using sensors 120, a plurality of electrolysis cells, and identify, for example via the monitoring, a cell with a certain behavior (for example a cell, such as a cell with unexpected electrical resistance, as in the case of a degrading cell) in the plurality of electrolysis cells. The control system can then be configured to modify an operational state of the plurality of electrolysis cells (for example by modifying an operational state of the degrading cell) by taking any of the actions mentioned above or other actions. In specific embodiments of the invention, the modification of the operational state can be performed while continuing to operate at least one other cell in the plurality of electrolysis cells.

An electrolysis system for converting $CO_x$ into chemicals can be a complex system subject to frequent failures and performance degradations. Also, the maintenance of an electrolysis system can be complex (for example due to numerous mechanical pieces, high compression of the bipolar/monopolar plates, etc.), time-consuming and therefore costly. Thus, it can be desirable to find ways to maintain the performance of the electrolysis system as well as to maximize its capacity factor (i.e., the ratio between the actual rate at which the plant production is operated vs. the maximum production rate), for example by minimizing the duration of maintenance operations.

Specific embodiments of the invention relate to methods for controlling an electrolysis system, such as the electrolysis system 100 described with reference to FIG. 1, and for automating the performance optimization of such electrolysis system. In specific embodiments, the methods described can provide, alternatively or in combination, ways for improving the performance of a $CO_x$-involving electrolysis reactor comprising multiple cells over an extended period of time, for minimizing the possible failures of the electrolysis cells, for minimizing the impact of the failure of an individual cell or of a group of cells on the performance of the overall system, and for minimizing the maintenance time to repair/replace a failed cell or a failed group of cells, among others.

As used herein, degradation of a cell/group of cells/stack or electrolysis reactor, including failure, can be understood as a degradation of at least one performance metric, such as its electrical resistance, compared to at least one reference value or threshold. The reference value can be stored in memory for the control system to access it and use it in analyzing the data from the sensors. Performance metrics that can be used include indicators, either measured or calculated, of how a cell/groups of cells/stack or electrolysis reactor performs. Examples of alternative performance metrics (non-exhaustive list) are: electrical potential difference (voltage) between the two electrodes of an electrolysis cell; electrical potential difference applied to the monopolar plates of a stack; sum of electrical potential differences for a group of cells, for different stacks, or for an electrolysis reactor; electrical current flowing across an electrolysis cell or a group of cells assembled in series or a stack; overpotential of an electrolysis cell for the production of at least one beneficial product, being defined as the difference between the measured potential difference across the two electrodes of the cell and the thermodynamic potential for the overall reaction occurring at the electrolysis cell (sum of anodic and cathodic reactions); overpotential of a group of cells, stack or electrolysis reactor; electrical resistance of a group of cells, a stack or an electrolysis reactor; selectivity or Faradaic efficiency for the production of at least one beneficial product, defined as the ratio between the measured molar quantity of beneficial product in the outlet fluid stream and the theoretical molar quantity that could be achieved if only this beneficial product was formed in the electrolysis cell/group of cells/stack/reactor; energy efficiency of an electrolysis cell for the production of at least one desired product chemical, being defined as the Faradaic efficiency times the ratio between the measured potential difference across two electrodes of an electrolysis cell and the thermodynamic potential for the overall reaction occurring at the electrolysis cell; energy efficiency of a group of cells, stack or electrolysis reactor; quantity of $CO_x$ converted into desired chemicals; quantity of desired chemicals formed; operation cost of the electrolysis reactor; among others.

Based on the aforementioned list of performance metrics, some non-exhaustive examples of undesired behaviors, such as failures, can be given. For example, a flooding of the cathode of a cell, resulting from the presence of water in excess at the anode or an inappropriate humidification of the $CO_x$-containing cathodic stream, may result in loss of selectivity for $CO_x$ reduction into beneficial products of the cell due to an increase of water reduction into $H_2$ at the cathode. This situation can cause the resistance of the cell to diminish and, for example, cross the threshold that defined a degraded mode. At the reactor level, the production of desired products in a flooding situation can be reduced. As another example, the accumulation of impurities at one or the other electrode of an electrolysis cell may result in a decrease of the electrical current flowing across the cell, an increase of the voltage/overpotential of the cell and thus in an increase of the resistance of the cell. As another example, excess cooling of an electrolysis stack may lead to a decrease of the current flowing across the stack/increase of its electrical resistance.

Figure 4:
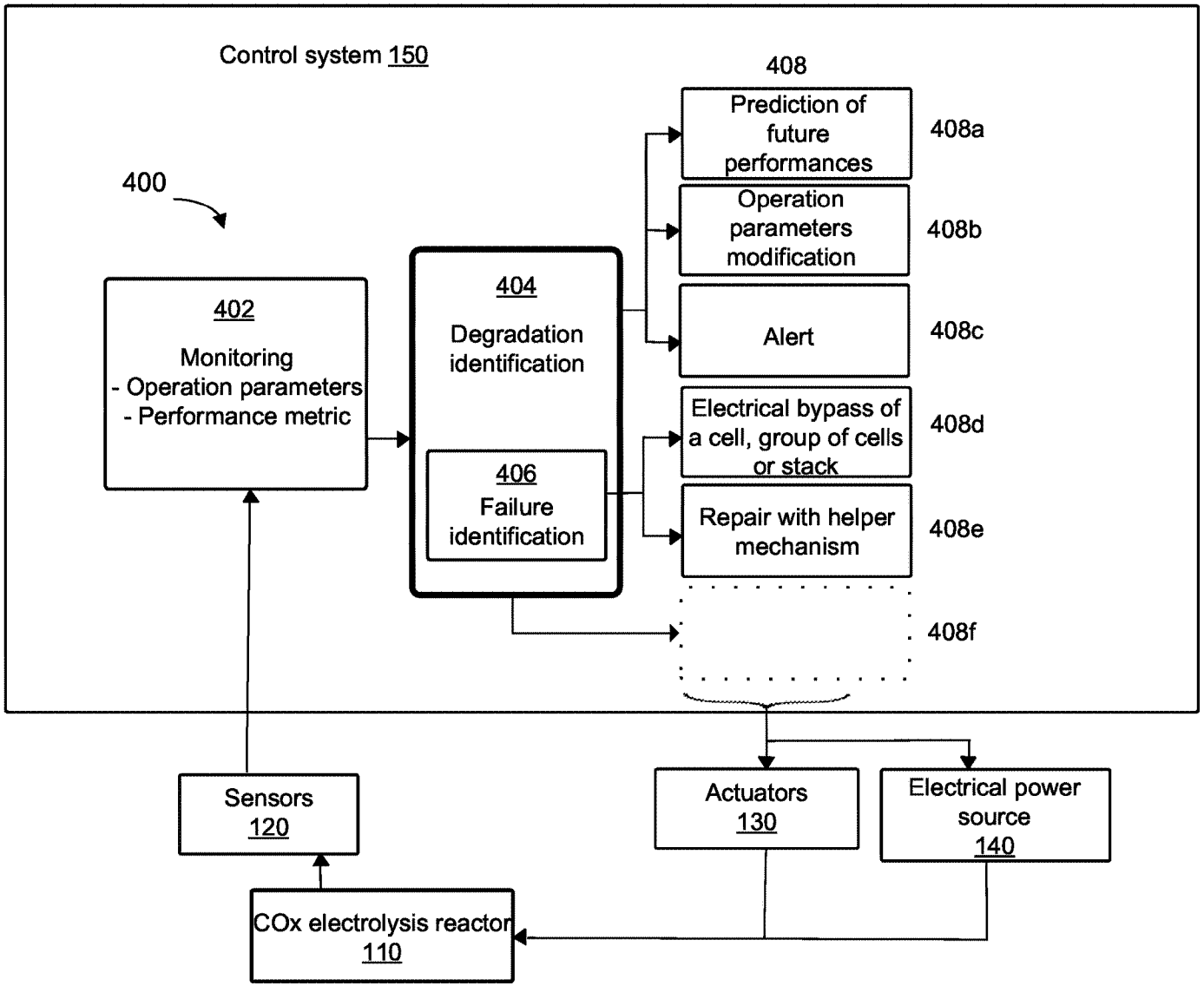
FIG. 4 includes a schematic view of a method for automating the performance optimization of an electrolysis system for converting $CO_x$ into chemicals, in accordance with specific embodiments of the invention disclosed herein.

FIG. 4 includes a schematic view of a method 400 for automating the performance optimization of an electrolysis system, such as electrolysis system 100 of FIG. 1, for converting $CO_x$ (such as $CO_2$ and CO) into chemicals. As illustrated, the method 400 can be performed by the control system 150, for example by one or more processors executing instructions stored in memory.

The method 400 includes a step 402 of monitoring at least one performance metric, such as the cell resistance of the different cells, possibly by monitoring cell voltages and currents, and/or one or several operational parameters. As explained, an operational parameter can be defined as a physical parameter of the electrolysis system that can be measured by the means of a sensor.

The method 400 further includes the step of detecting degradation 404, which can include in particular the detecting of a failure 406, of an electrolysis cell, a group of cells or a stack. The detecting 404 and/or 406 can be performed by comparing at least one performance metric, such as cell resistance, with its reference value. Upon detection of degradation 404 or failure 406, the method can include a step 408 of triggering one action or several actions such as, but not limited to: launching numerical simulations **408*a* of the future performances of the at least one cell, for example by using time series of past operational parameters as described in the following; changing the operation parameters 408*b* upon degradation identification; raising an alert 408*c*, for example to inform the operator of the electrolysis reactor that a threshold has been crossed (which can indicate a degrading state including a failed state) or, based on the results of numerical simulations 408*a*, that a threshold will be crossed for at least one performance metric such as cell resistance; electrically bypassing a failed cell/group of cells or stack 408*d* in case of failure identification; and/or using a help mechanism 408*e* for example to ease cell maintenance in case of failure identification. The mentioned actions are non-exhaustive and other multiple actions can be taken as indicated by placeholder 408***f*. These actions can be taken to modify an operational state of the system or part of the system, such as of a cell or group of cells. The methods 400 represent an overview of the steps that can be taken depending on the desired outcome. Details and examples of realizations of the methods for automating the performance optimization of an electrolysis system outlined in FIG. 5 will be given in the following.

In specific embodiments of the invention, the control system, such as control system 150 of FIG. 1, is configured for electrolysis failure mitigation. In an electrolysis system, it can be desirable to automate the mitigation of the effects of degrading or failed cells, groups of cells or stacks. This can ensure that the system can operate efficiently for a longer period of time without human intervention or maintenance. In this regard, specific embodiments of the invention refer to methods for mitigating the effects of a degrading cell on an electrolysis stack and methods for mitigating the effects of a degrading stack on an electrolysis reactor.

Figure 5:
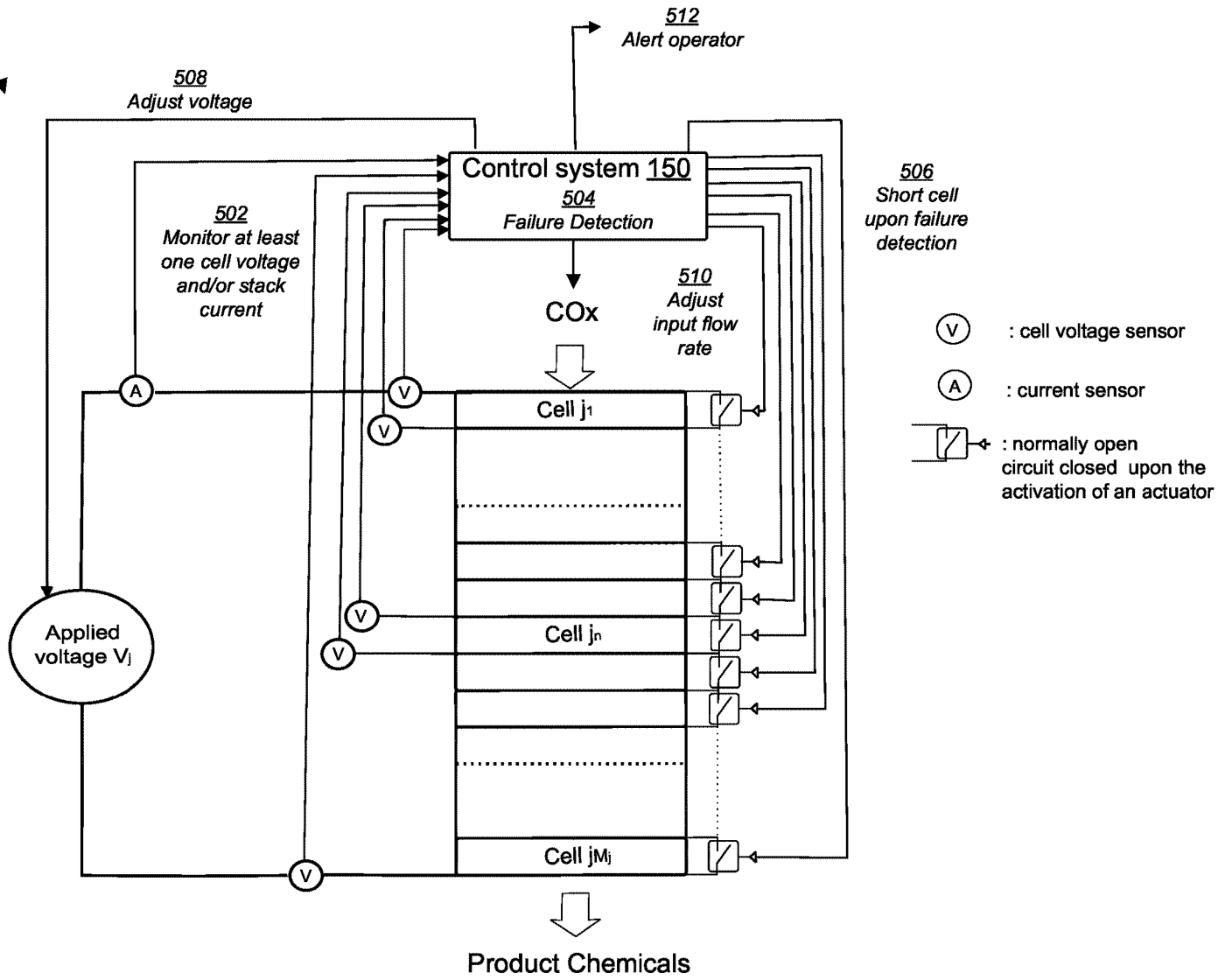
FIG. 5 includes a block diagram and flowchart for a method of mitigating the effects of a degrading cell on an electrolysis stack, in accordance with specific embodiments of the invention disclosed herein.

FIG. 5 includes a block diagram and flowchart for a method 500 of mitigating the effects of a degrading (e.g., failed) cell on an electrolysis stack. The method 500 comprises a step 502 of monitoring at least one cell voltage and/or stack current in order to infer the resistance of at least one cell. This step can include measuring at least one electrical potential difference (voltage) between the anode and cathode of an electrolysis cell and/or measuring the electrical current flowing across the stack. Optionally, this step can also include using impedance spectroscopy techniques to measure the cell resistance directly. Method 500 further includes a step 504 of detecting a failure, for example detecting a failure mode of at least one cell based on comparing at least one cell resistance with a reference value, and optionally with one or more other threshold values (for example to raise alerts), as described before in this disclosure with reference to FIG. 4. The detecting of a failure can include the detecting of a degrading and/or failed cell. As illustrated in FIG. 5 and also illustrated with reference to FIG. 4, this step can be performed by the control system 150.

Method 500 further includes performing an action (for example automatically) upon the detection of a failure mode. Various actions can be performed by the system as explained with reference to FIG. 4, and those actions can be performed individually or in combination with each another. For example, upon identification that a cell has passed the failure threshold, the cell can be electrically shorted, as represented by step 506. Electrical shorting of the cell can be conducted through the operation of a normally open electrical circuit located between the two electrodes of the cell, which can be closed upon activation of an actuator. The actuator can be an electronic device such as but not limited to mechanical relays or solid-state relays including transistors, thyristors, optocouplers, coil-based electrical contactors and so on. Optionally, motor-based mechanical devices can be used to close the normally open electrical shortage circuit.

As another example of actions that can be performed by the system, the voltage applied to the terminal electrodes of the stack comprising the degrading cell can be modified, as represented by step 508. The voltage can be either reduced to follow the drop in the electrical resistance of the stack following the cell shortage (energy efficiency optimization) or increased to ensure a constant $CO_x$ conversion rate into chemicals. The input $CO_x$ flow rate can be modified accordingly as represented by step 510. An alert can be generated for an operator as represented by step 512. Other threshold values can be defined to alert the operator that a cell is degrading and, possibly, launch simulations or take corrective actions to prevent cell failure, as will be described in more detail in this disclosure.

A method of mitigating the effects of a degrading (e.g., failed) cell on an electrolysis stack, such as method 500 described with reference to FIG. 5, can ensure that an electrolysis system, such as electrolysis system 100 of FIG. 1, operate efficiently for a longer period of time without human intervention or maintenance. One example of the benefits that can be achieved by shorting a failed cell is that it could avoid losing energy in the form of heat by Joule effect (a current flowing through a resistor dissipates energy in the form of heat, and the amount of energy dissipated in proportional to the resistance of the resistor) in the failed cell. This benefit can be important when the degradation is an increase of the resistance of the cell. Another example of benefits that can be achieved by shorting a failed cell is that it can avoid generating undesired products in the output stream of beneficial products in case the degradation causes a loss of selectivity. These and other scenarios are described in more detail below in this disclosure.

The method of mitigating the effects of a degrading (e.g., failed) cell on an electrolysis stack described with reference to FIG. 5 can be sequentially applied in a straightforward manner to mitigate the effects of a group of cells in a stack.

Figure 6:
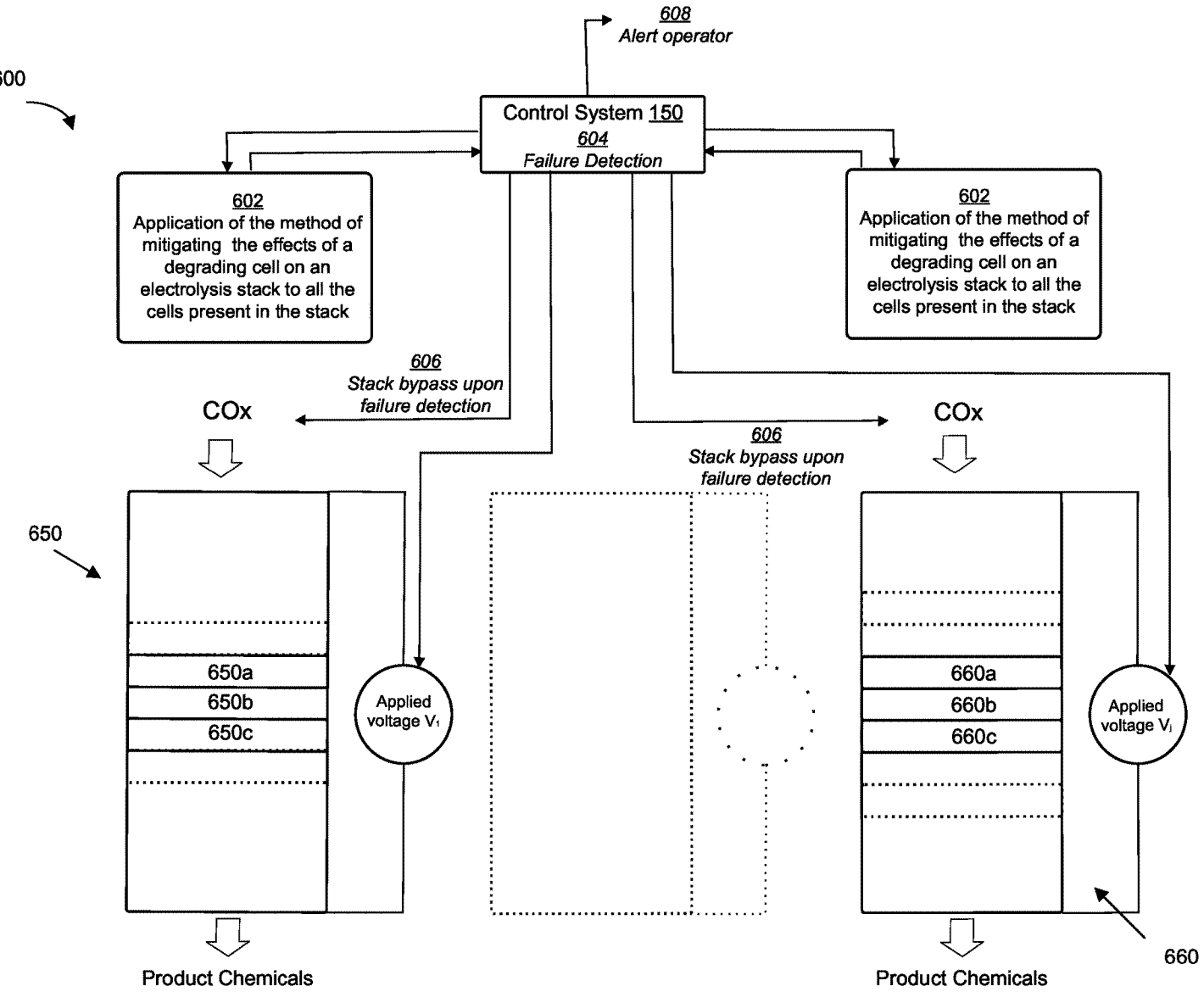
FIG. 6 includes a block diagram and flowchart for a method of mitigating the effects of a degrading stack on an electrolysis reactor, in accordance with specific embodiments of the invention disclosed herein.

FIG. 6 includes a block diagram and flowchart for a method 600 of mitigating the effects of a degrading (e.g., failed) stack on an electrolysis reactor. The method 600 can be applied simultaneously or sequentially to a plurality of stacks comprising a plurality of cells. FIG. 6 illustrates an example including stacks 650 and 660 comprising a plurality of cells such as cells 650*a*, 650*b*, 650*c*, 660*a*, 660*b*, 660*c*, but the invention is not limited to such configuration. When a significant proportion of cells fail in a stack, the stack itself may be considered as a failed stack. In that case, it can be desirable to minimize the influence of a degrading stack on the electrolysis system. The method 600 of mitigating the effects of a degrading stack on an electrolysis reactor comprises a step 602 of applying the method of mitigating the effects of a degrading cell on an electrolysis stack to all the stacks that compose the electrolysis reactor. Such step can involve the execution of the method 500 described with reference to FIG. 5.

Method 600 can further comprise a step 604 of detecting a failure, for example detecting a failure mode of at least one stack based on comparing either the number of cells shortened in the stack or other performance metrics with one threshold value (e.g., more than 20% of cells in a stack are bypassed), or two or more threshold values. For example, a stack can be considered to fail when the proportion of failed cells in the stack exceeds 5%, 10%, 20%, 30%, 40%, and/or 50%. In embodiments where the degrading cells are not shortened by the method of mitigating the effects of a degrading cell on an electrolysis stack, non-optimal cells can be left electrically connected on the circuit. In that case, other performance metrics such as the total electrical resistance of the stack can be used to identify a failure mode of the stack. In that case, a failed stack is defined by an electrical resistance differing from its reference value in relative terms for example by more than 3%, 5%, 10%, 20% and/or 30%. This difference can be either positive or negative. Other performance metrics such as but not limited to energy efficiency and selectivity of the stack can be used.

Method 600 further includes performing (e.g., automatically performing) one or more actions upon the detection of a failure, for example upon the detection of a thresholddependent failure mode, as described before in this disclosure. In specific embodiments of the invention, one threshold value can be set to electrically bypass a stack as represented by step 606. Electrical bypass can be made by stopping both the appliance of a voltage at the terminal electrodes (monopolar plates) of a stack and the input $CO_x$ flow stream. In specific embodiments of the invention, the voltage applied to the terminal electrodes of the other stacks can be automatically increased as well as the input $CO_x$ flow rate to ensure a constant $CO_x$ conversion rate into chemicals. Other actions are possible upon the detection of a failure as described before in this disclosure, for example, other threshold values might be defined to alert the operator of a failure or potential failure, for example to alert that a stack is progressively degrading, as represented by step 608.

In an electrolysis system comprising a large number of electrolysis stacks, the implementation of the method of mitigating the effects of a degrading stack on an electrolysis reactor can minimize the impact of the failed stacks on the overall system operation and can maximize the performances of the electrolysis system. It can also minimize the maintenance or modifications of the system required to maintain a level of performance in terms of low electricity consumption or high carbon dioxide conversion rate, for example. In embodiments that allow for automated modification of the voltages and input $CO_x$ flow rate of the non-failed stacks, a constant production of desired products can be achieved.

Specific embodiments of the invention relate to predictive models for failure avoidance of degrading cells or stacks and/or automatically adjusting operational parameters. The models can include artificial intelligence models. In an electrolysis system, it can be desirable to automatically adjust the operational parameters to prevent or delay cell or stack failures before actual failure occurs. This can increase the lifespan and overall efficiency of the electrolysis system. In particular, prediction capabilities can be used to identify probable cell or stack failures and classification capabilities can be used to identify the cause of the probable cell or stack failure. The automated adjustment of the operational parameters of an electrolysis system conditionally to the identification of probable cell or stack failures can then be used to prevent or delay cell or stack failures, as described before with reference to FIG. 4.

Methods for adjusting the operational parameters of an electrolysis stack to prevent cell or stack failures can generally comprise various steps such as a step of measuring at least one electrical potential difference (voltage) between the anode and cathode of an electrolysis cell and/or measuring the electrical current flowing across the stack. The methods can also include a step of measuring at least one operational parameter including, but not limited to, temperature, humidity, pressure and flow rate of the $CO_x$ flow stream at the cathode, or temperature, humidity, pressure and flow rate of the fluid fed at the anode, such as an ion-containing aqueous solution, pH of the anolyte, the molecular composition of the output stream of chemicals, including but not limited to concentration or proportion of CO, $CO_2$, $H_2$, $C_2H_4$, $C_2H_5OH$, $CH_4$, and other products as mentioned before in this disclosure. The methods can also include a step of storing the aforementioned measurements, for example in a control system memory in the form of a time series (or other series of data) comprising at least two-time steps. The methods can also include a step of using at least one model, such as a regression model, for example based on the analysis of the aforementioned stored measurements (e.g., time series) to predict future time series of at least one performance metric (e.g., cell resistance, cell voltage, stack current or any other performance metrics disclosed before). The methods can also include a step of using at least one classification model to predict possible failure modes of one or more cells in the stack based on the predicted future time series. The methods can also include a step of changing at least one operational parameter associated with the operation of a stack upon predicting a possible failure of one or several cells in order to alleviate the degrading cells before an actual failure occurs. Various examples of such methods and implementations are given in this disclosure.

Different models (e.g., regression models) can be used in a method of adjusting the operational parameters of an electrolysis stack to prevent cell or stack failures such as, but not limited to, linear regression, polynomial regression, kernel-based regressions, neural network, deep neural networks, decision trees, random forest regressions or any other machine-learning inspired regression models or a combination of these models. These models can take as inputs either the sole measured time series of the output parameter (cell resistance and/or other performance metrics), or several measured time series of different operation parameters and/or output parameter. The output of these models can be a cell resistance, but it can also be a cell voltage, the stack current or any other performance metrics. For example, an exponential smoothing model taking only one cell resistance measured time series can be used to forecast a cell resistance without explicitly considering the influence of other operation parameters (temperature, pressure, humidity, etc.). Such a model could be refined to linearly or polynomially correlate the cell resistance to the cell temperature and humidity of the input $CO_x$ flow stream. In specific embodiments of the invention, a neural network can be used to output the stack current based on the past time series of the cell resistances, humidity and pressure of input $CO_x$ flow stream and average temperature of the stack.

Different classification models can be used to predict possible failures of one or more cells in stack based on the predicted future time series such as, but not limited to, threshold models, decision trees, k-means clustering models, support vector machine models, any machine-learning inspired classification model or a combination of these. These models can be used to analyze the cause of a failure mode and help the control system to automatically modify the operational parameters in order to alleviate the degrading cells before failure occurs thus increasing their longevity. For example, failure modes of an electrolysis cell can be classified with a k-means clustering model taking as input the speed of degradation of the cell resistance. A sharp decline in the forecasted cell resistance may be attributed to a probable hole in formation in the membrane whereas a slow increase in the forecasted cell resistance may indicate the accumulation of impurities on the electrodes blocking the catalytic reduction of $CO_x$ into desired products. By using additional concentration or proportion measurements of at least one product in the output flow of product chemicals, flooding events (i.e., undesired presence of large quantities of water at cathode) can be identified since flooding events can increase the probability that water is electrochemically reduced at the cathode translating into a higher proportion of di-hydrogen $H_2$ in the output flow of product chemicals.

Upon classification of a failure mode, the operation parameters can be modified by the control system based on some intelligent understanding of the failure cause. For instance, if a probable accumulation of impurities on the cathode catalytic sites is predicted by the method of adjusting the operational parameters of an electrolysis stack to prevent cell or stack failures, the control system can trigger a rinse procedure of the cathode by temporarily diverting the input $CO_x$ flow stream and injecting a rinse flow composed of water. Similarly, if the formation of a hole in the membrane is forecasted, the method of mitigating the effects of a degrading cell on an electrolysis stack can be used to temporarily electrically short the cell and inject membrane reparation products in the cathodic or anodic flow stream. The voltage applied to terminal electrodes of the stack could also be reduced to lower the load on the cells. Other modifications of the operation parameters can include increasing the flow of anodic stream at the anode to cool down the stack, lowering or increasing the flow of input gas while increasing or diminishing the pressure, among others. Another example includes the detection of flooding events, for example by measuring the concentration or proportion of $H_2$ in the output flow stream of beneficial products, which may be used to adjust (e.g., automatically) operational parameters of the electrolysis system, such as humidity of the input $CO_2$ or CO flow stream, to reduce the amount of water available at the cathode.

Specific embodiments of the invention refer to mechanisms for repairing a cell, for example, repairing cell without full disassembly. In an electrolysis system, such as system 100 of FIG. 1, it can be desirable to maximize the capacity factor (i.e., the ratio between the actual rate at which the plant production is operated vs. the maximum production rate), for example by minimizing the duration of maintenance operations. Helper mechanisms whether manually operated or automated can provide ways to achieve this task. This section describes two such helper mechanisms.

An electrolysis stack may be combined with a helper system to facilitate the maintenance of the stack. This helper mechanical system, when combined with the stack, can allow the compression of parts of the stack (e.g., sub-stacks as previously defined) around one or more cells to be maintained compressed while disassembling and changing/regenerating a failed cell. In specific embodiments, maintaining compression of well-functioning portions of the stack can be key to allowing facile and rapid maintenance through targeted and localized disassembling while maintaining high performance of the non-modified cells after such maintenance operation.

In specific situations, it can be critical to maintain compression and alignment of the non-degrading cells for the cells to retain their performance (similar to those obtained prior to maintenance) as the electrolysis system is restarted after modifications of other stack components. In specific embodiments of the invention, the helper system may be automatically controlled by any means including the control system 150, an independent control system, or manually, by an operator. Various designs may be envisioned for the helper system and its interaction with the electrolysis stack to ensure the described characteristic. Two non-limiting examples are provided below.

Figure 7:
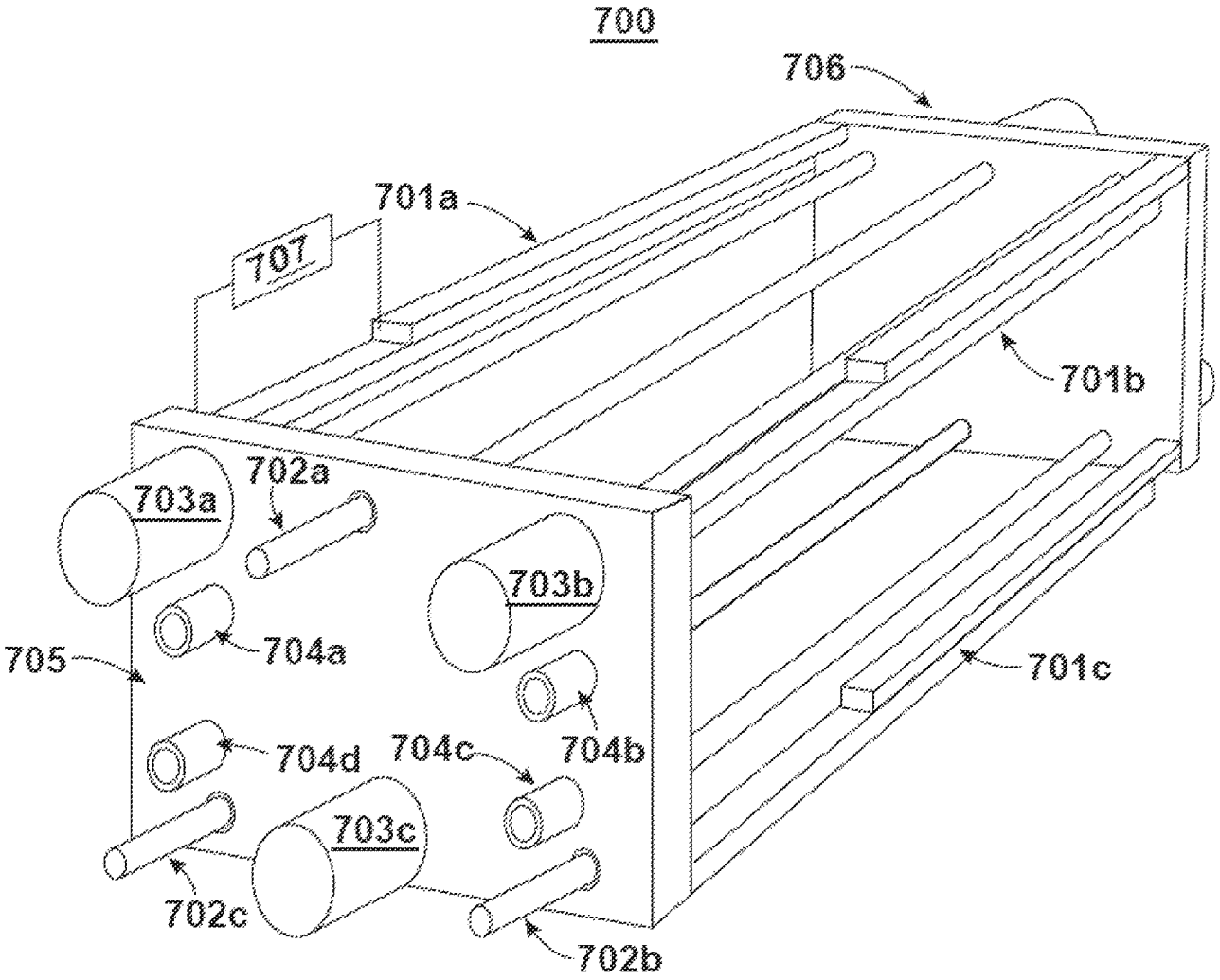
FIG. 7 includes an example of a helper system, in accordance with specific embodiments of the invention disclosed herein.
Figure 8:
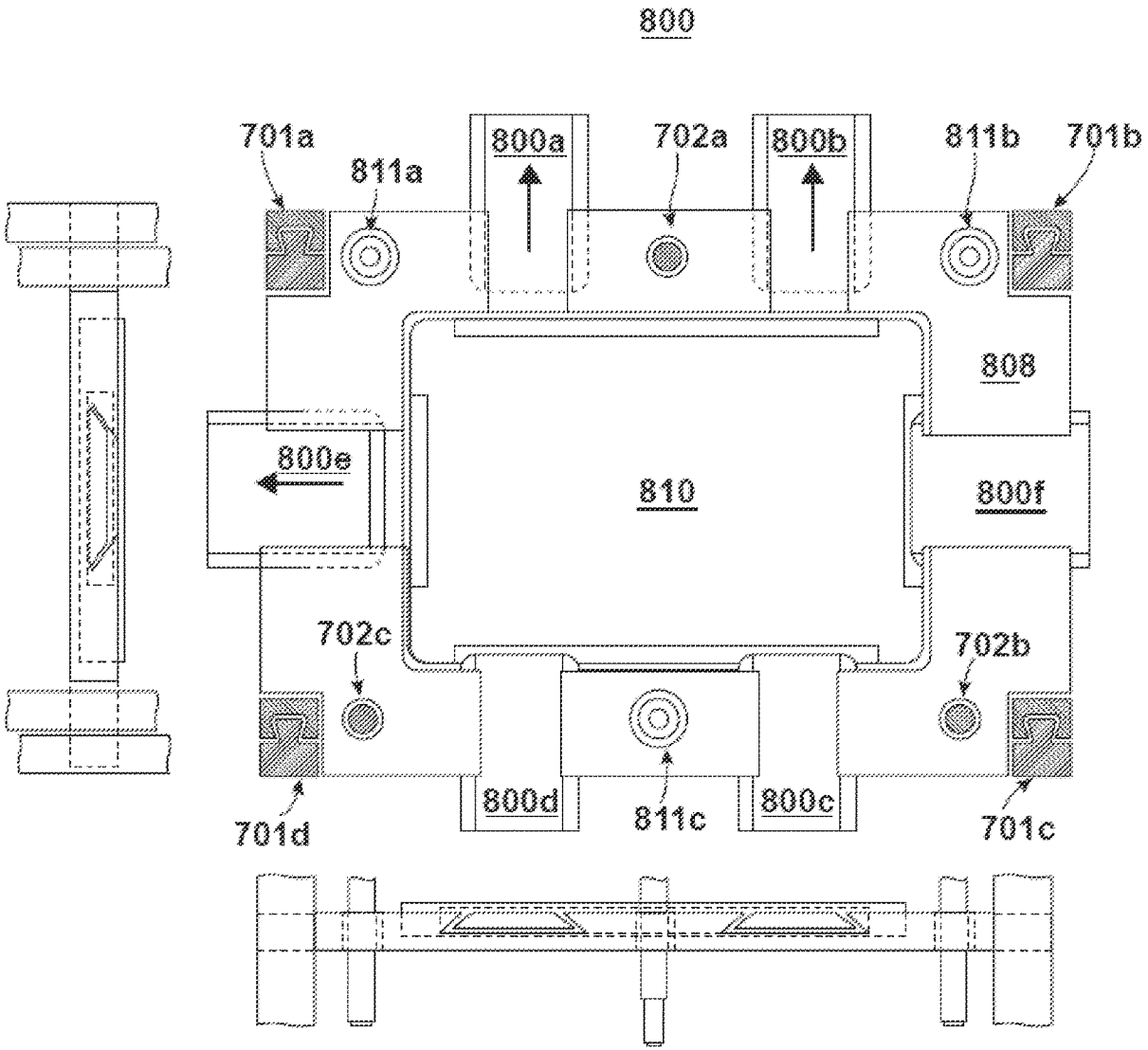
FIG. 8 includes an example of a peripheral gliding locking system of the helper system of FIG. 7, in accordance with specific embodiments of the invention disclosed herein.

The first example refers to a helper system based on gliding peripheral sub-stack locking system. FIG. 7 includes an example 700 of the helper system and FIG. 8 includes an example of the peripheral gliding locking system of the helper system. FIG. 7 and FIG. 8 illustrate the example of a stack outer casing comprising end plates (705, 706), rails (701*a*, 701*b*, 701*c* and 701*d*) that surround the central electrolysis stack (not represented herein for clarity) and ensure its mechanical holding and compression that is determined by an external tightening system of any kind, 707. FIG. 8 exhibits a peripheral gliding locking system 808 surrounding a polar plate, 810 (bipolar or monopolar) to which it mechanically attaches itself through the lateral dents (800*a*, 800*b*, 800*c*, 800*d*, 800*f* and 800*e*) by entering indents machined in the thickness of the central plate, 810. The peripheral gliding locking system 808 is recessed within the frame created by the rails (701*a*, 701*b*, 701*c* and 701*d*) located at its four corners to guide its movement alongside the thickness of the stack. It is attached to one of the end plates through rigid bars (such as but not limited to threaded rods, ball screw-based systems) in order to allow the application of a pressure on the sub-stack situated between this end plate and stack plate it is attached to (through the dents). The compression of this sub-stack can be ensured by tightening the rigid bars to a targeted level of compression, to be monitored by pressure sensors of any kind, not represented herein. Such tightening may be operated by systems such as but not limited to motors located on the end plate as exemplified in 703*a*, 703*b*, 703*c*. The ports 704*a*, 704*b*, 704*c*, 704*d* represent the manifolds for fluid circulation within the electrolysis stack; they are represented on the same end plate as an example but could also be located on different end plates and/or at different locations of the plates.

Holes 811*a*, 811*b*, 811*c* in the represented peripheral gliding locking system can be designed in order to enable the passage of rigid bars dedicated to a second peripheral gliding locking system. This way, by positioning the peripheral gliding locking system on polar plates on each side of a failed cell or series of cells, it is possible to maintain the compression on sub-stacks on each side of the failed cell or series of cells. By loosening the compression of the overall stack acting on 707, it can then be possible to access and realize maintenance operations on one or a series of failed cells, while keeping the rest of the stack intact. Once the maintenance operation is performed, the full stack can be compressed again to the targeted compression level, to be monitored by pressure sensors of any kind, and the peripheral gliding locking system can be dissociated from the plate by pulling out the lateral dents (800*a*, 800*b*, 800*c*, 800*d*, 800*f* and 800*e*) from the plate indents.

Figure 9:
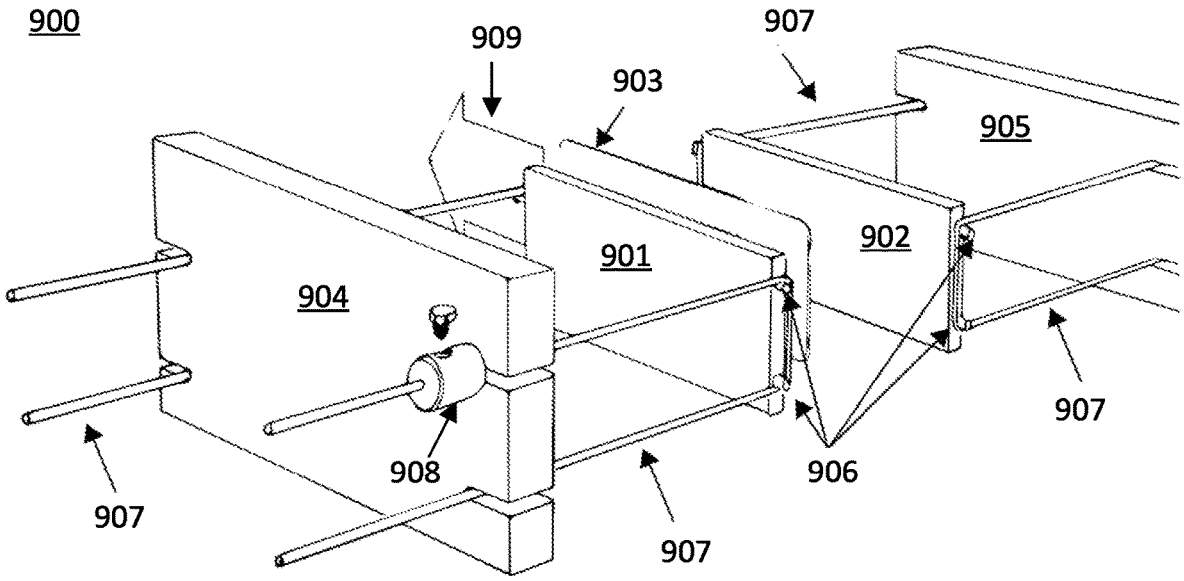
FIG. 9 includes another example of a helper system and its integration within a stack to maintain compression of two sub-stacks surrounding a central MEA to be replaced during the decompression of the full stack.
Figure 9:
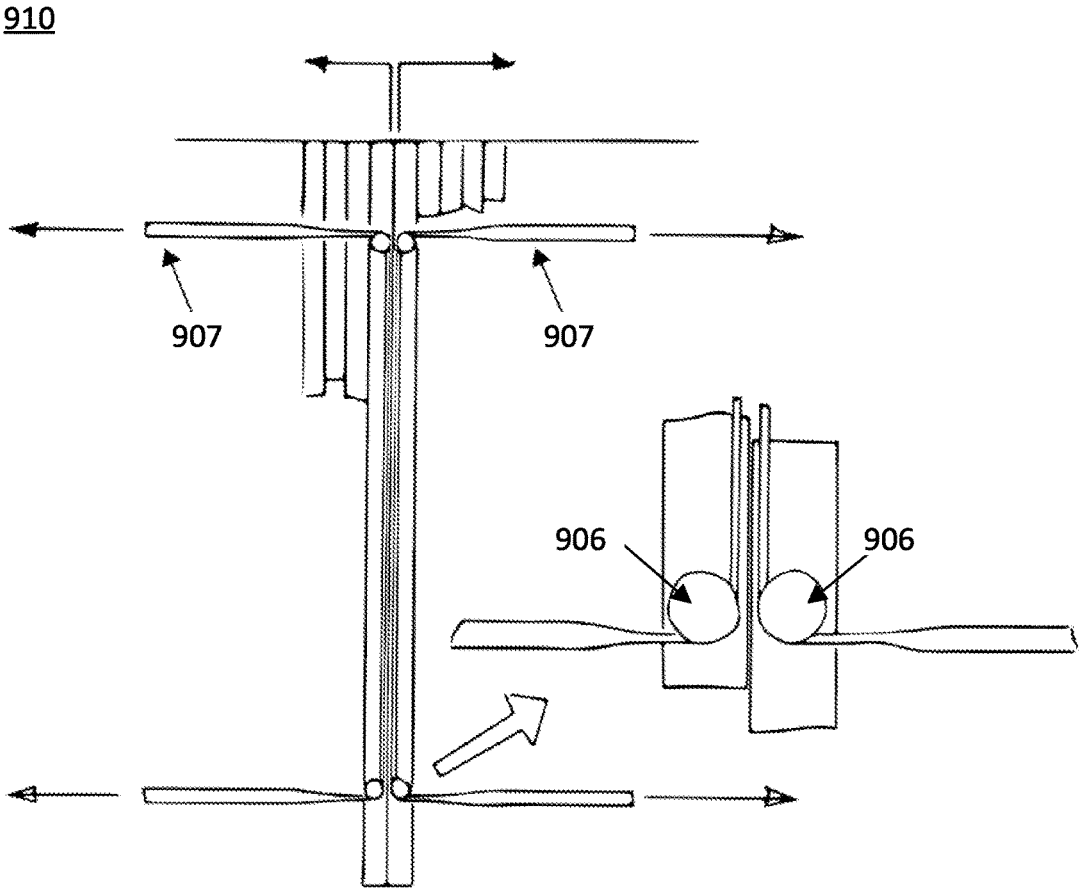

FIG. 9 includes another example of a helper system and its integration within a stack in order to maintain compression of two sub-stacks surrounding a central MEA to be replaced during the decompression of the full stack. For simplicity, only the two bipolar plates 901, 902 directly adjacent to the MEA to be replaced, 903, have been represented in view 900. Yet, the system can be designed to maintain compression of both the sub-stacks, comprising respectively i) all the polar plates (bipolar or monopolar) between bipolar plate 901 and end plate 904; and ii) all the plates (bipolar or monopolar) between bipolar plate 902 and end plate 905.

Examples of the systems as the ones presented above include stacks of electrolysis cells comprising cells, that in turn can include plates as described above (monopolar plates that are part of one cell, bipolar plates that are part of two cells on either side). The electrolysis stack can also include a casing and a locking mechanism (as described above) for the plate and at least part of the stack casing to be maintained together under a certain degree of compression while moving or being moved away from the remaining of the stack. The stack can include guides, for example for the plates and the stack casing to move. The guides can be separate guides or integrated guides. One or more additional locking mechanisms can also be included in the stack. For example, there can be provided a locking mechanism to fix a second plate of the cell (and not the plate that is moving), relative to a portion of the stack under the degree of compression when the first plate moves or is being moved away from that portion of the stack. The stack casing can include endplates of the stack of electrolysis cells.

The plate can include an accessible interface, such as a laterally accessible interface, and a connector, such as a removable connector of the locking mechanisms, that can be configured to mate with the laterally accessible interface. An actuator of the locking mechanisms can be connected to the connector to impart the degree of compression, as described and illustrated with reference to element 707 in FIG. 7. For example, the laterally accessible interface can be a socket in the plate, while the removable connection can be a paddle. As another example, the removable connector can be configured to be inserted into one or more indentations of the stack casing when being mated to the laterally accessible interface. The locking mechanisms described above can operate with a control loop which can use data from a pressure sensor, for example, as at least part a feedback signal for the control loop. In specific embodiments of the invention and as illustrated above, the locking mechanism can include an actuator and a threaded post that extends through the first stack casing. The actuator can rotate the threaded post to impart the degree of compression.

In specific embodiments of the invention, using the helper systems described above, a degrading cell can be replaced by, for example, moving a plate of the degrading cell, together with the stack casing comprising the electrolysis cells. Other cells can be located between the plate and the stack casing, and they can continue to perform as expected after the replacement has taken place. In specific embodiments, the cells can even be configured to continue to perform during the replacement process.

In the illustrated helper system of FIG. 9, each bipolar plate comprises one or more protrusions such as but not limited to tappets, 906, as exemplified herein. These can allow for U-shaped mechanisms, 907, to be inserted on each side of the sub-stacks in order to maintain their respective compression by joining the end plate (904 for instance) and the final plate of the sub-stack (901) as illustrated in more detail in view 910. Compression of the sub-stacks can be adjustable by locking systems, 908. Once each sub-stack is compressed, the full stack may be uncompressed allowing for rapid and easy extraction, 909, of the MEA.

Figure 10:
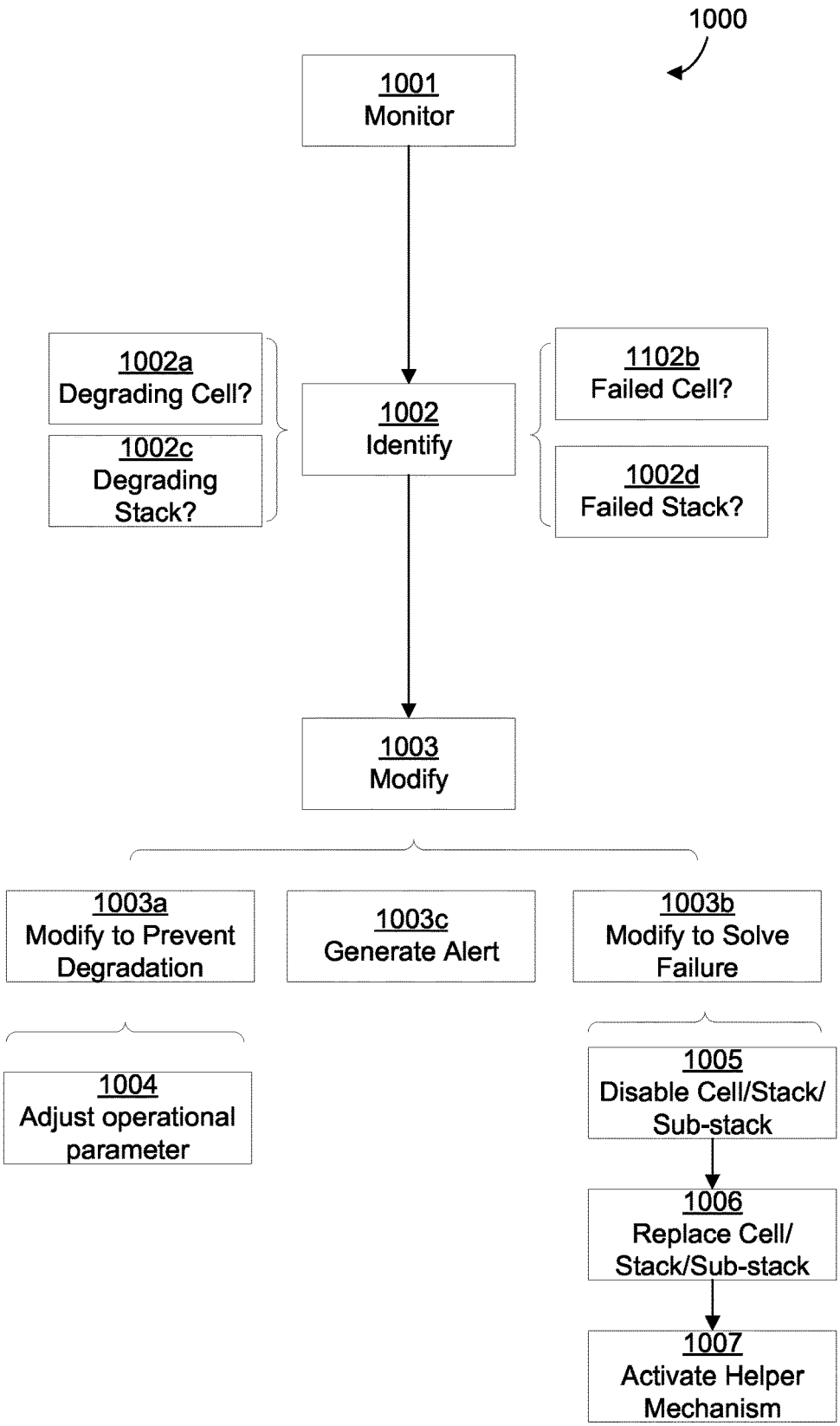
FIG. 10 includes a flow chart that summarizes some of the methods described herein and the relationship between them, in accordance with specific embodiments of the invention disclosed herein.

FIG. 10 includes a flow chart 1000 that summarizes some of the methods described herein and the relationship between them. Flow chart 1000 starts with a step 1001 of monitoring the electrolysis system. The monitoring step can be carried out as described in any of the methods described above and can include individually monitoring a cell, a group of cells and or a group of stacks. The monitoring can be made via at least one sensor. Operational characteristics can be monitored, including performance metrics and operational parameters, as described before in this disclosure.

Flow chart 1000 continues with step 1002 of identifying an undesired condition. The identifying could include comparing a measured value with a reference value or threshold, as described previously in this disclosure. For example, step 1002 can include identifying a degrading cell 1002*a* (for example a cell for which a performance metric is approaching to a failure threshold or is not performing as expected). Step 1002 can also include identifying a failed cell 1102*b* (for example a cell that is not working or a cell for which a performance metric has exceeded a failure threshold). Step 1002 can also include identifying a degrading stack 1002*c* (for example a stack with more than an acceptable number of degrading and/or failed cells). Step 1002 can also include identifying a failed stack 1002*d* (for example a stack that is not working or that has more than an acceptable number of failed cells). These are non-exhaustive examples of what step 1002 could entail. The idea is that the system is capable of recognizing both a potential failure and an actual failure, and act accordingly.

Flow chart 1000 continues with step 1003 of modifying an operational state of the system (for example an operational state of a cell, a group of cells, a stack). The modifying can be done upon the identifying in step 1002 and while continuing to operate at least one other cell in the system. Various non-limiting examples of the modifying step 1003 are given in flow chart 1000 and include the actions taken by the system as explained for the other methods described in this disclosure such as triggering an alarm 1003*c*. Since the methods are intended for identifying both a potential failure and an actual failure, the modifying step can be split depending on the desired remedy. For example, if the outcome of step 1002 is that there is a degrading cell or degrading stack in the form of a cell that could potentially fail, but has not yet failed, the modifying step 1003 can include steps to prevent degradation 1003*a*. In this way, the life of the degrading cells/stacks can be extended, and actual failure can be avoided or at least delayed. If the outcome of step 1002 is that a degrading cell or stack in the form of a failed cell or stack has been detected, the modifying step 1003 can include steps to solve the failure 1003*b*.

Various examples are given throughout the specification for modifying the operational state of a system or part of it, for example, it can be possible to adjust operational parameters 1004 of the system to extend the life of degrading cells/stacks. On the other hand, it can be possible to disable a cell, group of cells, or stacks if failing 1005. In this way, the system can continue working regardless of the fact that some cells/stacks are failed. This can be done by bypassing those cells/stack such as via electrical bypass. For example, if a degrading cell is in parallel with another cell in the power circuit of the electrolysis system, the disabling of the degrading cell can comprise disconnecting the degrading cell from the power circuit of the electrolysis system. The disabling can include any number of operations such as configuring the cell/stack in a state where it is not consuming energy, not producing, in an inactive state, not reducing $CO_x$, replacing flow with different flow, etc. If cells are in series, a cell can be bypassed, for example by the use of a conductor. If the cells are in parallel, a cell can be open, and the flow stopped. In this way, various actions can be taken as part of the disabling step, for example opening the circuit so that no electricity flows through the stack for disabling a stack; shorting a cell (e.g., with a piece of conductive metal) for disabling a cell; disabling individual cells one after another for disabling a group of cells; etc.

A next step could include the actual replacement of the cells/stacks 1006. This step could be reached when there are too many disabled cells in the system or as desired by an operator. The replacement of the cells can then include the use of the helper mechanism 1007 described in this disclosure, in order to reduce maintenance time. In this way, the combination of methods and systems disclosed herein aid in extending the life of an electrolysis system by providing means not only to monitor in order to identify degradation, but also to perform, for example automatically upon the detection of such degradation, changes in the system to delay degradation and failure. Furthermore, the system and methods provide means to continue to operate the system even when failure is detected and means to remedy those failures quickly and effectively.

While the specification has been described in detail with respect to specific embodiments of the invention, it will be appreciated that those skilled in the art, upon attaining an understanding of the foregoing, may readily conceive of alterations to, variations of, and equivalents to these embodiments. Any of the method steps discussed above can be conducted by a processor operating with a computer-readable non-transitory medium storing instructions for those method steps. The computer-readable medium may be memory within a personal user device or a network accessible memory. These and other modifications and variations to the present invention may be practiced by those skilled in the art, without departing from the scope of the present invention, which is more particularly set forth in the appended claims.

What is claimed is:

1. A method for controlling an electrolysis system with a plurality of electrolysis cells, wherein the electrolysis system converts a fluidic flow containing $CO_x$ into at least one chemical, the method comprising:

monitoring, using at least one sensor, the plurality of electrolysis cells;

identifying, via the monitoring, a degrading cell in the plurality of electrolysis cells; and modifying, upon the identifying of the degrading cell and while continuing to operate at least one other cell in the plurality of electrolysis cells, an operational state of the plurality of electrolysis cells.

2. The method of claim 1, wherein the degrading cell is a cell whose electrical resistance differs from a reference value.

3. The method of claim 2, wherein the reference value of the electrical resistance of the degrading cell is defined as an averaged electrical resistance of a sub-group of the plurality of electrolysis cells.

4. The method of claim 1, wherein the modifying of the operational state of the plurality of electrolysis cells comprises at least one of: (i) modifying an operational parameter of the degrading cell to prolong operation of the degrading cell; (ii) disabling the degrading cell; and (iii) replacing the degrading cell.

5. The method of claim 4, wherein the disabling of the degrading cell comprises:

electrically disabling the degrading cell.

6. The method of claim 4, wherein:

the degrading cell is in parallel with the at least one other cell in a power circuit of the electrolysis system; and the disabling of the degrading cell comprises disconnecting the degrading cell from the power circuit of the electrolysis system.

7. The method of claim 4, further comprising:

identifying, via the monitoring, a set of degrading cells in the plurality of electrolysis cells prior to identifying the degrading cell;

wherein the degrading cell and the set of degrading cells are in a stack of electrolysis cells; and wherein the disabling comprises disabling the stack of electrolysis cells.

8. The method of claim 1, wherein:

the degrading cell is in a stack of electrolysis cells; and the at least one other cell is in the stack of electrolysis cells.

9. The method of claim 1, wherein the identifying of the degrading cell comprises one of:

comparing a cell resistance of the degrading cell with a reference value; and predicting an evolution of the cell resistance of the degrading cell based on a plurality of past measures of said cell resistance and of operational parameters of the plurality of electrolysis cells.

10. The method of claim 9, wherein the predicting uses artificial intelligence models.

11. The method of claim 1, further comprising:

generating an alert signal that identifies the degrading cell.

12. The method of claim 1, further comprising replacing the degrading cell by:

moving a plate of the degrading cell, together with a first stack casing of a stack of electrolysis cells;

wherein the plurality of electrolysis cells are in the stack of electrolysis cells; and wherein the at least one other cell in the plurality of electrolysis cells is in the stack of electrolysis cells between the plate of the degrading cell and the first stack casing.

13. An electrolysis system comprising:

a plurality of electrolysis cells configured to receive a fluidic flow containing $CO_x$ and convert the $CO_x$ into at least one chemical;

at least one sensor configured to monitor the plurality of electrolysis cells;

at least one processor; and non-transitory computer-readable media accessible to the at least one processor and storing instructions which, when executed by the at least one processor, cause the system to:

monitor, using the at least one sensor, the plurality of electrolysis cells;

identify, via the monitoring, a degrading cell in the plurality of electrolysis cells; and modify, upon the identifying of the degrading cell and while continuing to operate at least one other cell in the plurality of electrolysis cells, an operational state of the plurality of electrolysis cells.

14. The system of claim 13, wherein the degrading cell is a cell whose electrical resistance differs from a reference value.

15. The system of claim 14, wherein the reference value of the electrical resistance of the degrading cell is defined as an averaged electrical resistance of a group of cells within the plurality of electrolysis cells.

16. The system of claim 13, wherein the modifying of the operational state of the plurality of electrolysis cell comprises at least one of: (i) modifying an operational parameter of the degrading cell to prolong operation of the degrading cell; (ii) disabling the degrading cell; and (iii) facilitating replacement of the degrading cell using a helper mechanism.

17. The system of claim 16, wherein the disabling of the degrading cell comprises:

electrically disabling the degrading cell.

18. The system of claim 16, wherein:

the degrading cell is in parallel with the at least one other cell in a power circuit of the electrolysis system; and the disabling of the degrading cell comprises disconnecting the degrading cell from the power circuit of the electrolysis system.

19. The system of claim 16, further comprising:

identifying, via the monitoring, a set of degrading cells in the plurality of electrolysis cells prior to identifying the degrading cell, wherein the degrading cell is not in the set of degrading cells;

wherein the degrading cell and the set of degrading cells are in a stack of electrolysis cells; and wherein the disabling comprises disabling the stack of electrolysis cells.

20. The system of claim 13, wherein the identifying of the degrading cell comprises one of:

comparing a cell resistance of the degrading cell with a reference value; and predicting an evolution of the cell resistance of the degrading cell based on a plurality of past measures of said cell resistance and of operational parameters of the plurality of electrolysis cells.

21. The system of claim 20, wherein the predicting uses artificial intelligence models.

22. The system of claim 13, further comprising:

a plate of the degrading cell;

a stack of electrolysis cells;

a first stack casing of the stack of electrolysis cells, located on a first end of the stack of electrolysis cells;

at least one locking mechanism for the plate and the first stack casing to move away, under a degree of compression, from a second end of the stack of electrolysis cells;

wherein the plurality of electrolysis cells are in the stack of electrolysis cells; and wherein the at least one other cell in the plurality of electrolysis cells is in the stack of electrolysis cells between the plate of the degrading cell and the first stack casing.

* * * * *